US008028477B2

(12) United States Patent
Crookston

(10) Patent No.: US 8,028,477 B2
(45) **Date of Patent: *Oct. 4, 2011**

(54) TRUSS GUSSET PLATE AND ANCHOR SAFETY SYSTEM

(76) Inventor: Lawrence A. Crookston, Barberton, OH (US)

( * ) Notice: Subject to any disclaimer, the term of this patent is extended or adjusted under 35 U.S.C. 154(b) by 461 days.

This patent is subject to a terminal disclaimer.

(21) Appl. No.: 12/100,122

(22) Filed: Apr. 9, 2008

(65) Prior Publication Data

US 2008/0222972 A1 Sep. 18, 2008

Related U.S. Application Data

(63) Continuation-in-part of application No. 11/069,819, filed on Mar. 1, 2005, now Pat. No. 7,380,373.

(51) Int. Cl.
*E04B 1/38* (2006.01)

(52) U.S. Cl. ..... 52/127.5; 52/749.12; 52/92.2; 52/712; 182/45

(58) Field of Classification Search ..... 52/749.12, 52/745.21, 127.5, 698, 695, 92.2, 93.1, 712; 182/3, 45; 403/232.1, 235, 241; 411/461, 411/462, 463, 464, 465, 466, 467, 468
See application file for complete search history.

(56) References Cited

U.S. PATENT DOCUMENTS

| | | | |
|---|---|---|---|
| 3,162,719 | A | 12/1964 | Mulford |
| 3,423,898 | A | 1/1969 | Tracy et al. |
| 3,703,304 | A | 11/1972 | Losee |
| 4,910,934 | A | 3/1990 | Hennings |
| 4,946,123 | A | 8/1990 | Albert |
| 5,137,112 | A | 8/1992 | Nichols |
| 5,143,171 | A | 9/1992 | Glynn et al. |
| 5,165,642 | A | 11/1992 | Rihaly |
| 5,248,021 | A | 9/1993 | Nichols |
| 5,282,597 | A | 2/1994 | Babcock |
| 5,287,944 | A | 2/1994 | Woodyard |
| 5,346,036 | A | 9/1994 | Arisman et al. |

(Continued)

FOREIGN PATENT DOCUMENTS

| | | |
|---|---|---|
| GB | 2251020 | 6/1992 |

(Continued)

OTHER PUBLICATIONS

Super Anchor Safety, Fall Protection Equipment, Full Line Catalog, 2004, 28 pages.

*Primary Examiner* — Eileen D Lillis
*Assistant Examiner* — Chi Nguyen
(74) *Attorney, Agent, or Firm* — Sand & Sebolt

(57) ABSTRACT

A peak gusset for securing a safety line for a workman, a roof truss and an anchoring system incorporating the same. The gusset is a substantially planar plate including an attachment region, a coplanar anchor portion and bendable flaps. A plurality of teeth extends from the attachment region and into the side of a truss member adjacent the peak. The anchor portion extends laterally beyond the peak and a hole defined therein receives the security line. The hole is disposed above an upper surface of the truss member and vertically beneath the peak. The gusset is non-removable and does not need to be cut down before a ventilation cap is applied thereover. A pair of peak gussets can be secured on either side of a truss and a connector member for attachment of the security line can extend between peak gussets on adjacent trusses.

23 Claims, 37 Drawing Sheets

U.S. PATENT DOCUMENTS

| | | | | |
|---|---|---|---|---|
| 5,361,558 | A | 11/1994 | Thornton et al. | |
| 5,370,202 | A | 12/1994 | Nichols | |
| 5,553,685 | A | 9/1996 | Cook | |
| 5,558,312 | A | 9/1996 | Brennan | |
| 5,595,260 | A | 1/1997 | Jalla | |
| 5,687,535 | A | 11/1997 | Rohlf | |
| 5,727,646 | A | 3/1998 | Gray | |
| 5,730,407 | A | 3/1998 | Ostrobrod | |
| 5,850,889 | A | 12/1998 | Rexroad et al. | |
| 5,896,719 | A | 4/1999 | Thornton | |
| 6,098,746 | A | 8/2000 | Castaneda | |
| 6,241,205 | B1 | 6/2001 | Affrunti | |
| 6,691,826 | B1 | 2/2004 | Dean | |
| 6,705,018 | B2 | 3/2004 | Guhse | |
| 6,763,910 | B2 * | 7/2004 | Cole | 182/3 |
| 6,779,316 | B2 | 8/2004 | Carroll | |
| 6,786,020 | B2 | 9/2004 | Poldmaa | |
| 6,877,291 | B2 | 4/2005 | Shamroukh et al. | |
| 6,966,531 | B2 | 11/2005 | Curtin | |
| 7,380,373 | B2 * | 6/2008 | Crookston | 52/127.5 |
| 2003/0051429 | A1 * | 3/2003 | Hovenier | 52/651.1 |

FOREIGN PATENT DOCUMENTS

| | | |
|---|---|---|
| GB | 2291100 | 1/1996 |
| GB | 2397845 | 8/2004 |

* cited by examiner

TRUSS GUSSET PLATE AND ANCHOR SAFETY SYSTEM

CROSS-REFERENCE TO RELATED APPLICATIONS

This is a Continuation-in-Part of U.S. patent application Ser. No. 11/069,819, filed Mar. 1, 2005, the entire disclosure of which is incorporated herein by reference.

TECHNICAL FIELD

This invention relates to a roof truss connector plate and roof anchor safety system and, in particular, to a connector plate comprising an anchor portion extending therefrom. The anchor portion allows various components of the roof anchor system to be secured to the roof. The truss connector plates are factory installed when the roof truss is formed and provide certifiable anchor capacity to the user.

BACKGROUND OF THE INVENTION

The need for securing roofing workers on pitched roofs is well known and is now being required by many government regulations. Many safety systems have been developed to secure workers, with the majority involving an anchor attached to either a rafter of a truss or to the surface of the roof. These prior art anchor systems may be temporary or permanent.

A problem with all of these prior art systems is that they rely on a roofing worker to initially attach the anchor. This often can result in the anchor being attached incorrectly. The potential misconnection of anchor bolts, screws and brackets, and the resulting personal injury, is a serious problem with the prior art safety systems. Additionally, due to the potential liability, building contractors many times retain independent sub-contractors that are expected to provide proper protection, but many times fail to do so. The difficulty and potential for improper installation lead to disastrous results if a roof worker should fall, and the need therefore exists for a simple, integrated approach to provide roof safety to every construction site.

Accordingly, there is a need for providing a roof anchor system that overcomes problems associated with the prior art.

SUMMARY OF THE INVENTION

A peak gusset for securing a safety line for a workman, a roof truss and an anchoring system incorporating the same. The gusset is a substantially planar plate including an attachment region, a coplanar anchor portion and bendable flaps. A plurality of teeth extends from the attachment region and into the side of a truss member adjacent the peak. The anchor portion extends laterally beyond the peak and a hole defined therein receives the security line. The hole is disposed above an upper surface of the truss member and vertically beneath the peak. The gusset is non-removable and does not need to be cut down before a ventilation cap is applied thereover. A pair of peak gussets can be secured on either side of a truss and a connector member for attachment of the security line can extend between peak gussets on adjacent trusses.

BRIEF DESCRIPTION OF THE DRAWINGS

This invention will now be described in further detail with reference to the accompanying drawings, in which.

DETAILED DESCRIPTION OF THE INVENTION

Figure 1B:
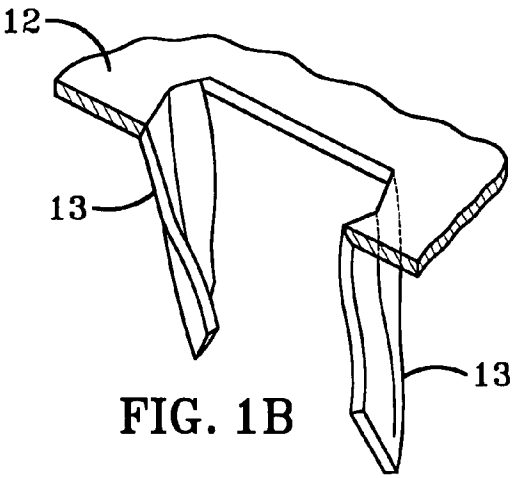
FIG. 1A is a front view of a peak gusset of a roof anchor system of the present invention and FIG. 1B is a detail perspective view of one of the plurality of teeth of the peak gusset of FIG. 1A.
Figure 1A:
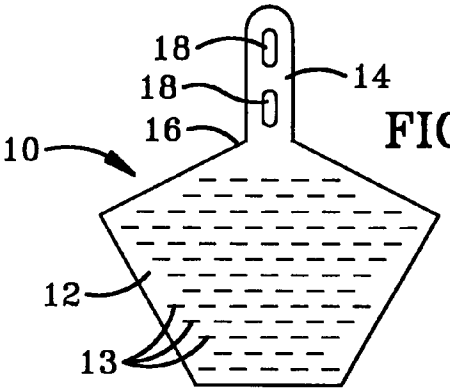

The present invention is directed to an integrated roof safety system wherein successful attachment of this device is assured because it is designed to be installed under ideal and regulated factory conditions. The provision of this device, by the general building contractor, for use by the various hired subsequent subtrades, will create a safe workplace and cause more compliance with existing government regulations. The result will be practical, economical and failsafe product and system. The roof anchor safety system 110 of the present invention will now be described in detail with reference to various embodiments thereof. Referring now to FIG. 1A, a truss connector plate 10 for use at the peak of a truss and referred to herein as a peak gusset 10 is shown and comprises the primary component of the roof anchor safety system 110. The peak gusset 10 comprises a plate 12 of steel having a plurality of teeth 13 formed from the plate 12 and extending perpendicularly from the plate 12 as best shown in FIG. 1B. Referring back to FIG. 1A, the exact shape of the plate being unimportant, it is only necessary that the plate be of sufficient size and geometry to resist anticipated pull forces. The peak gusset 10 further comprises an anchor portion 14 extending from the peak side 16 of the gusset 10. The peak gusset 10 is monolithic such that the anchor portion 14 is an extension of the plate 12. The anchor portion 14 includes a means for attachment 18 of other safety items, the attachment means shown herein as a pair of apertures 18 in the form a of slot 18. It is noted that other attachment means are contemplate such as an open slot for engaging a stud of the type used for bayonet connection, or other known connection devices. The thickness of the gusset 10 may be of a standard gusset thickness, typically 16-20 gauge, or may be made of a thicker gauge for added strength.

Figure 2:
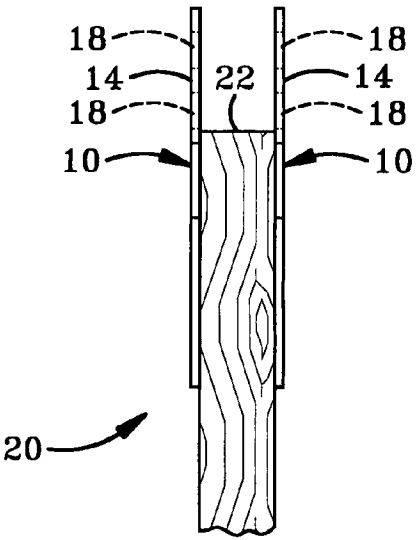
FIG. 2 is a side view of a pair of peak gussets, as shown in FIG. 1, attached to a truss rafter.

A peak gusset 10 is attached to either side of a truss peak 22 as shown in FIG. 2. The plurality of teeth (not shown) is pressed into the wooden truss peak 22 during manufacture of the truss 20 typically using a roll or hydraulic press. Manufacture of the truss is accomplished at the factory under standard environmental conditions to control the quality and strength of the truss. The anchor portion 14 extends outward from the truss peak 22. At lease one aperture 18 provides a connection location for other elements of the roof anchor safety system 110. Although not shown, it is contemplated that the anchor portion 14 can be formed with vertically extending ribs in a pressed single or multiple wave or corrugated type configuration to add additional strength to the anchor portion 14 of the gusset 10. Between the manufacture and installation of the truss 20, the anchor portion 14 may be covered with a protective coating or covering (not shown) such as foam wrap or the like in order to protect the anchor portion 14 as well as worker handing the truss 20. A wooden piece of strap material may also be inserted between the anchor portions 14 and temporarily secured to provide additional protection against bending or other damage to the anchor portions 14 during handling and transportation.

Figure 3:
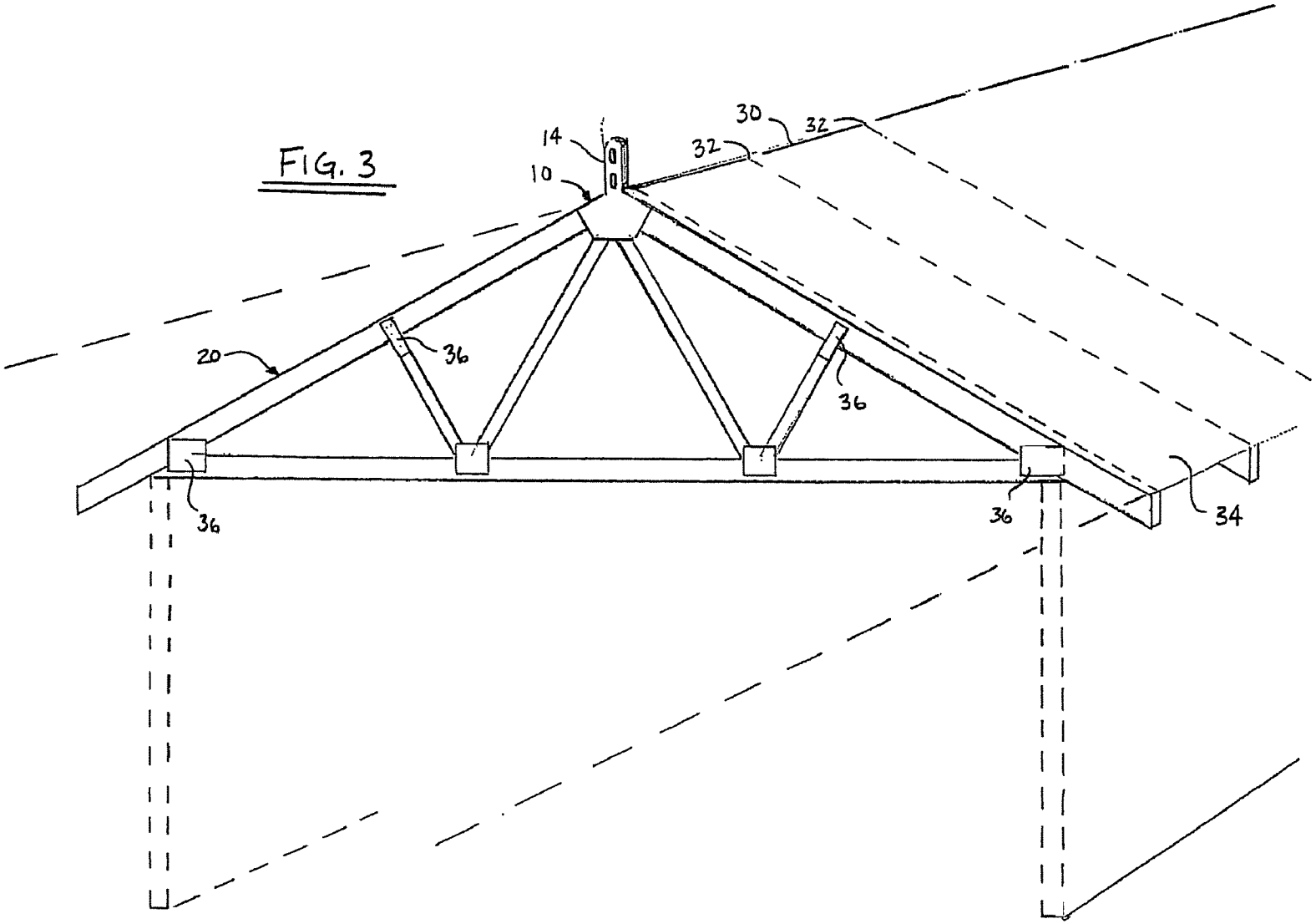
FIG. 3 is a perspective view of a truss formed with the peak gussets of FIG. 1 and shown with a building structure generally shown in phantom.

The resulting truss 20 is shown in FIG. 3 with the peak gusset 10 positioned such that the anchor portion 14 of the gusset 10 extends upward from a ridge line 30 formed by the other truss peaks 32 of the roof 34 (shown in phantom). The anchor portion 14 provides an attachment location for D-rings, hooks, cables, and other means of securing a person while working on the roof 34. It is important to note that, although the peak gusset 10 is shown in the present disclosure solely at the peak of a truss 20, it is contemplate that the other truss connection plates 36 could be configured with an anchor portion as well.

Figure 4:
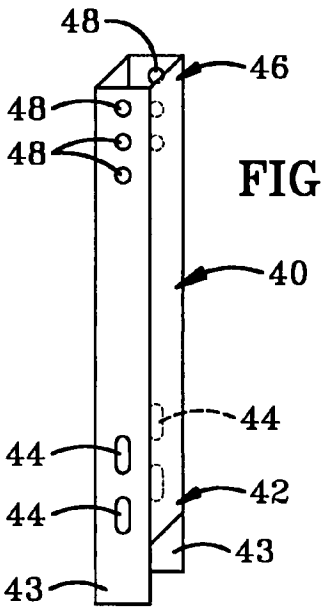
FIG. 4 is a perspective view of a high reach accessory of the roof anchor system of the present invention.

The roof anchor system 110 of the present invention further comprises an anchor extension member 40 referred to as a high reach accessory 40 as shown in FIG. 4. The high reach accessory 40 is essentially an extension bar of a predetermined length that attaches at a first end 42 to the peak gusset 10. The first end 42 may also include sidewall extensions 43 that extend over the sides of the truss peak 22 to provide additional stability and prevent low-impact side-to-side collapse of the anchor portions 14 of the gussets 10. The first end 42 fits over the anchor portions 14 and includes an attachment means 44 for securing the high reach accessory 40 to the anchor portions 14 herein shown as apertures 44 in the form of slots 44. The opposite end 46 of the high reach accessory 40 includes attachment means 48 for attachment of other safety items, the attachment means 48 shown herein as a plurality of apertures 48.

Figure 5:
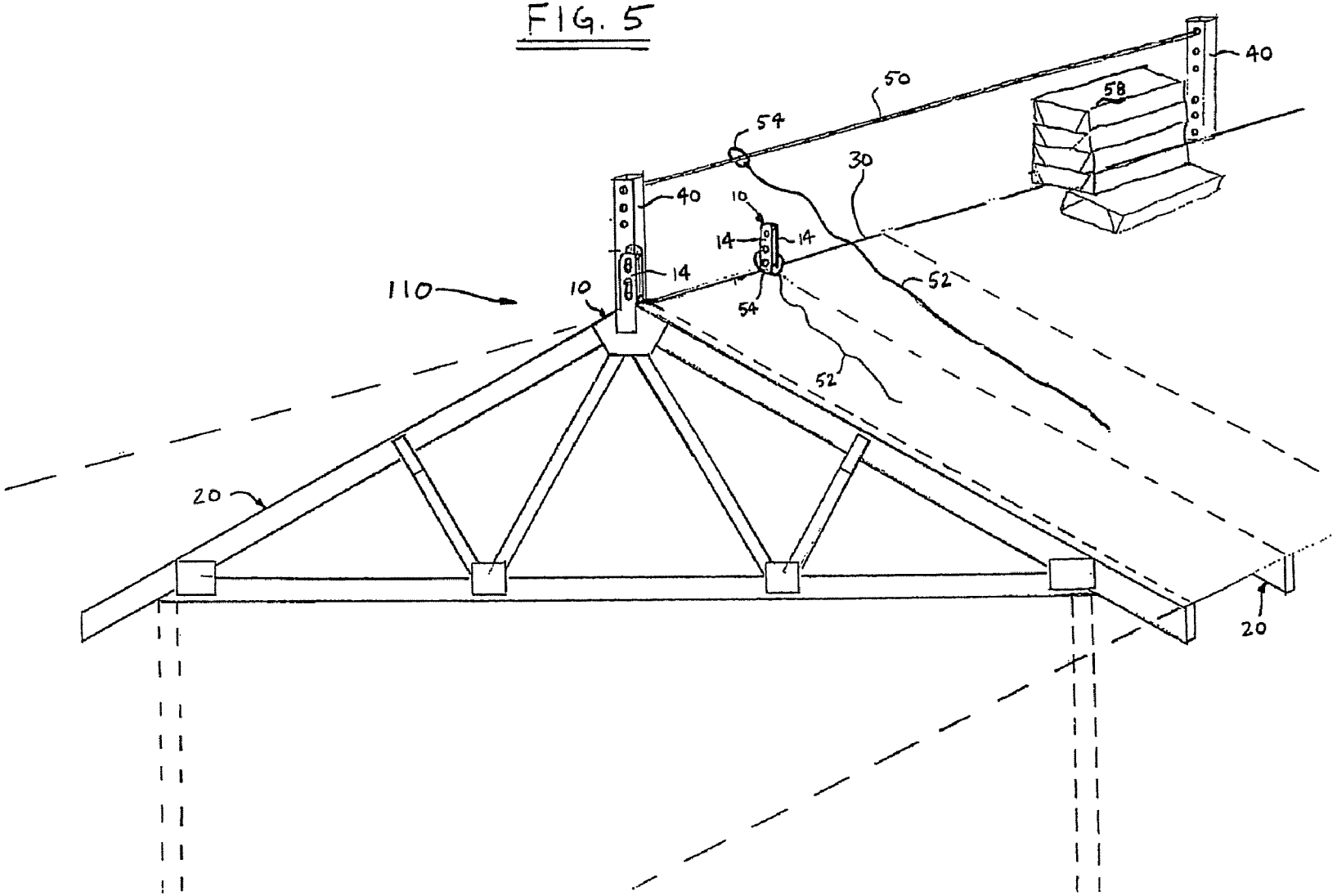
FIG. 5 is a perspective view of a roof having the roof anchor system of the present invention attached thereto.

The roof anchor safety system 110 of the present invention is shown in FIG. 5. A truss 20 is shown having peak gussets 10 attached thereto. A high reach accessory 40 is shown attached over the anchor portion 14 (shown as visible even though covered) of the peak gussets 10. A second high reach accessory 40 is attached to a second peak gusset (not shown) further down the ridge line 30. A tether line 40 is attached to and extends between the high reach accessories 40. A harness line 52 is shown slidably attached to the tether line 50 by an attachment ring 54. An additional truss 20 is shown having peak gussets 10 and is positioned between the two high reach accessories 40. A harness line 52 is shown attached to the anchor portions 14 of the peak gussets 10 by an attachment ring 54. Squares of shingles 58 are shown positioned along the ridge line 30.

Figure 6:
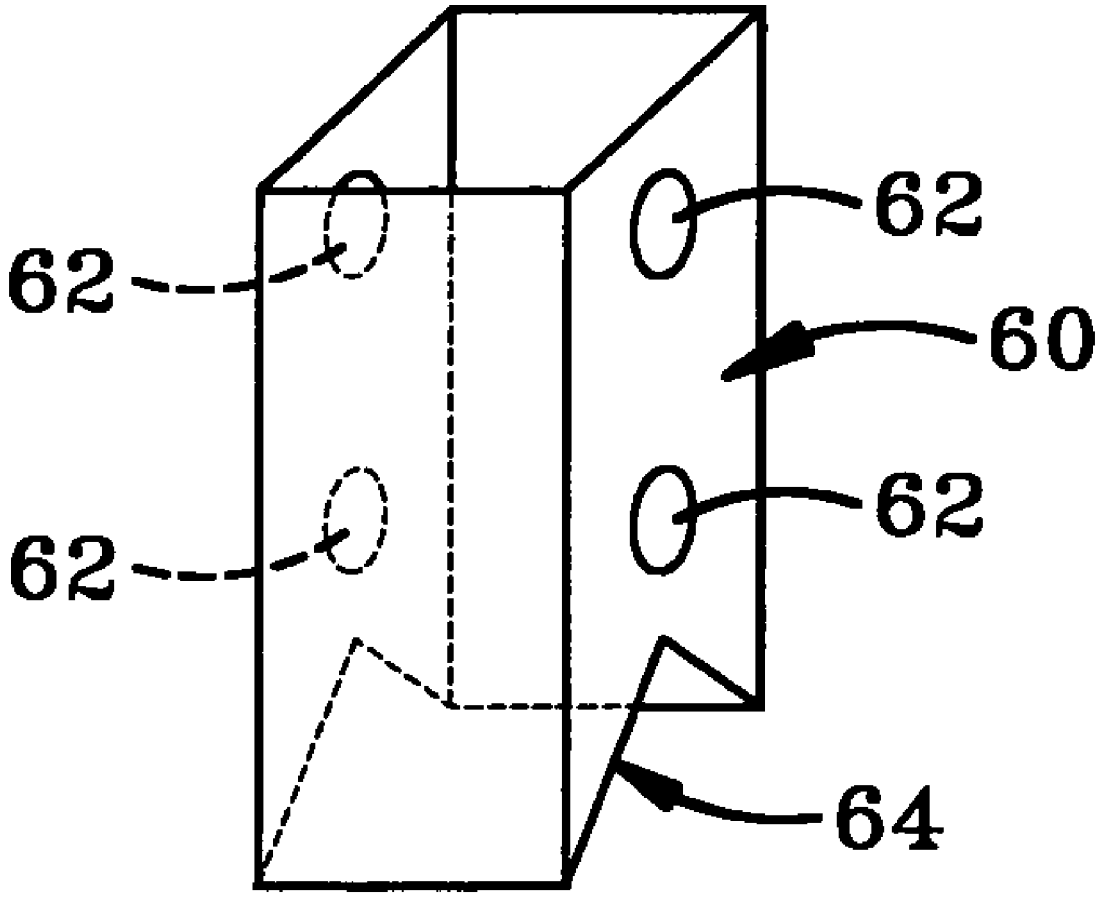
FIG. 6 is a perspective view of a support ferrule insert of the roof anchor system of the present invention.

FIG. 6, a support ferrule insert is shown for insertion between the anchor portions 14 of the gussets 10 to provide additional support and strength to the anchor portions 14. The support ferrule 60 includes apertures 62. The support ferrule 60 is shown as a tubular member or it may be a solid block. The support ferrule 60 is positioned prior to attachment of the high reach accessory 40. The support ferrule 60 may also include a first end 64 that is formed at an angle to mate with or bridge the peak of the truss 20 and provides additional support to prevent front-to-back low impact collapse of the anchor portions 14 of the gussets 10.

When the roof anchor safety system 110 is no longer needed, the harnesses 52, tether lines 50, high reach accessories 40, D-rings 54 and the like, and support ferrule inserts 60, are removed from the anchor portions 14 and used again as needed. The anchor portions 14 are typically cut near the top of the truss 20 and then folded over the top of the truss 20. Alternatively, the anchor portions 14 may not need to be cut but rather just be bent over the truss and positioned below the roof. It is also contemplated that the anchor portions 14 may be covered and left in place, with or without a ferrule insert support 60 between the extensions 14.

Figure 8:
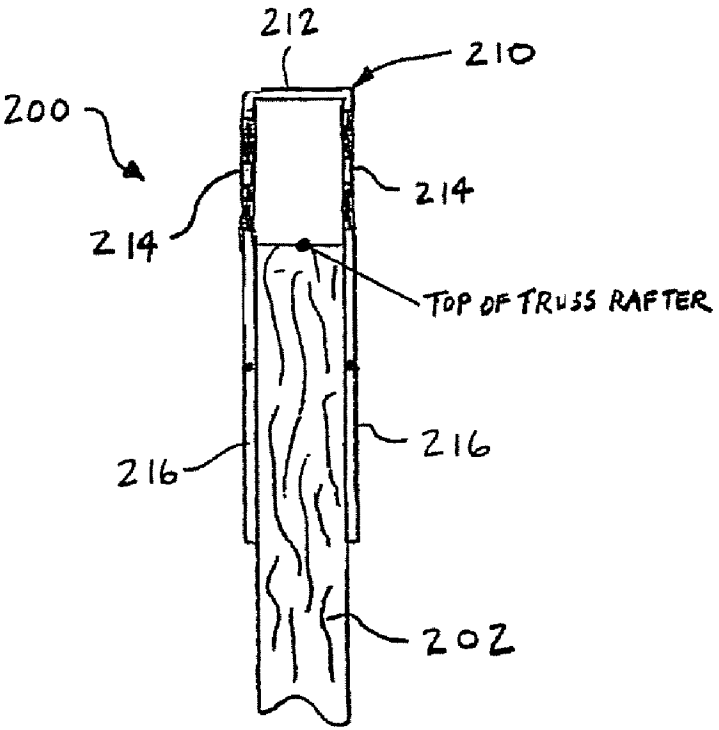
FIG. 8 is a side view of the double gusset of FIG. 7 shown attached to a truss rafter.
Figure 7:
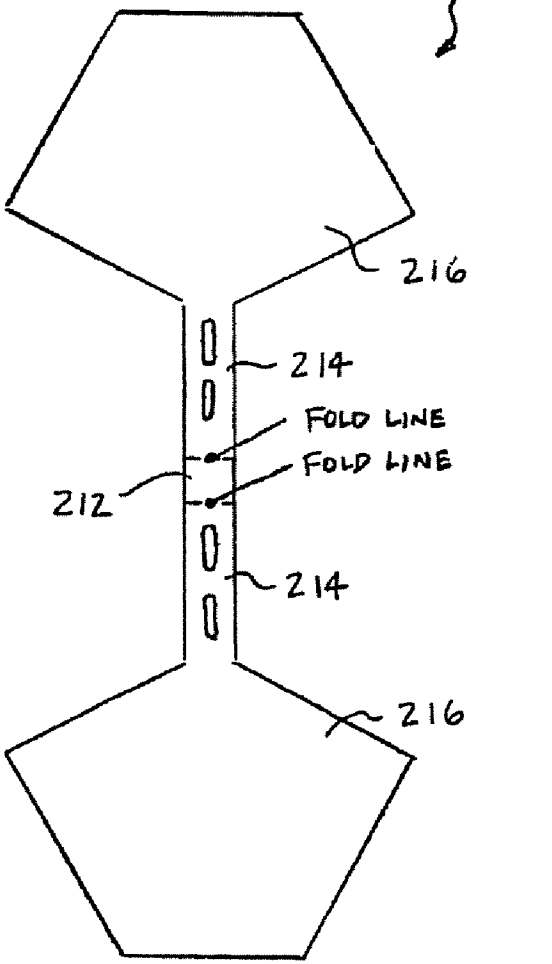
FIG. 7 is a front view of a second embodiment of the peak gusset of the present invention shown in a single piece configuration.
Figure 9:
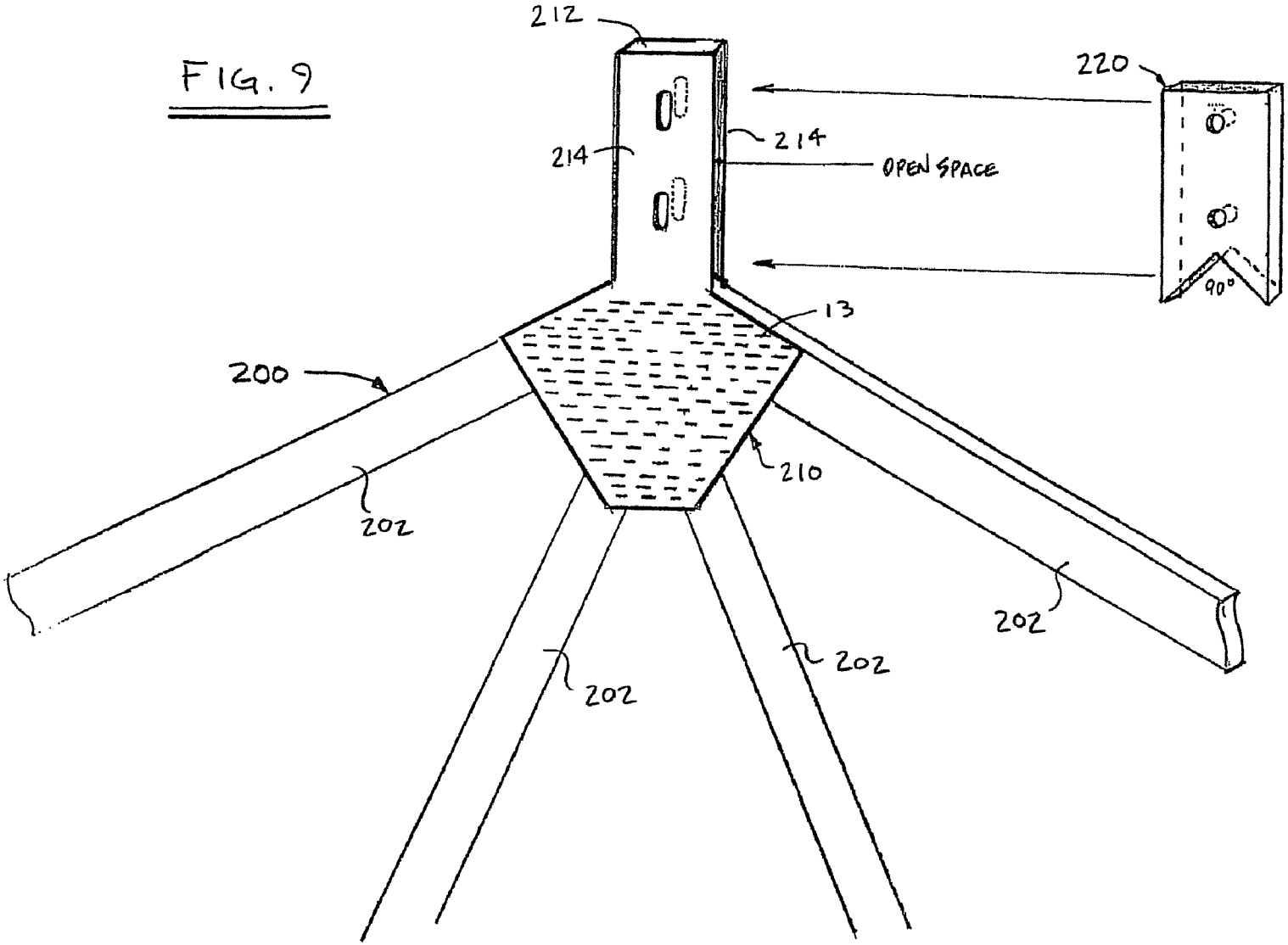
FIG. 9 is a partial perspective view of a truss formed with the double peak gusset of FIG. 7 and a support ferrule of FIG. 6 shown exploded therefrom.

In FIGS. 7-12, two additional embodiment of the peak gusset 210,310 are shown that are manufactured as one piece and then folded prior to attachment to form the truss 200, 300. Referring now to FIG. 7, a double peak gusset 210 is shown having a connection portion 212 between the anchor portions 214 of the double gusset 210. A plurality of teeth (not shown) extends perpendicularly from each plate portion 216. The double peak gusset 210 is folded on either end of connection portion 212 and attached to form a truss 200 by the plurality of teeth (not shown) engaging the truss members 202 as shown in FIG. 8. The attached peak gusset 210 is shown in a partial perspective view in FIG. 9. The peak gusset anchor portions 214 remain connected by connection portion 212, providing enhanced strength of the anchor portions 214. A support ferrule insert 220 is shown as insertable between the anchor portions 214 and underneath the connection portion 212.

Figure 11:
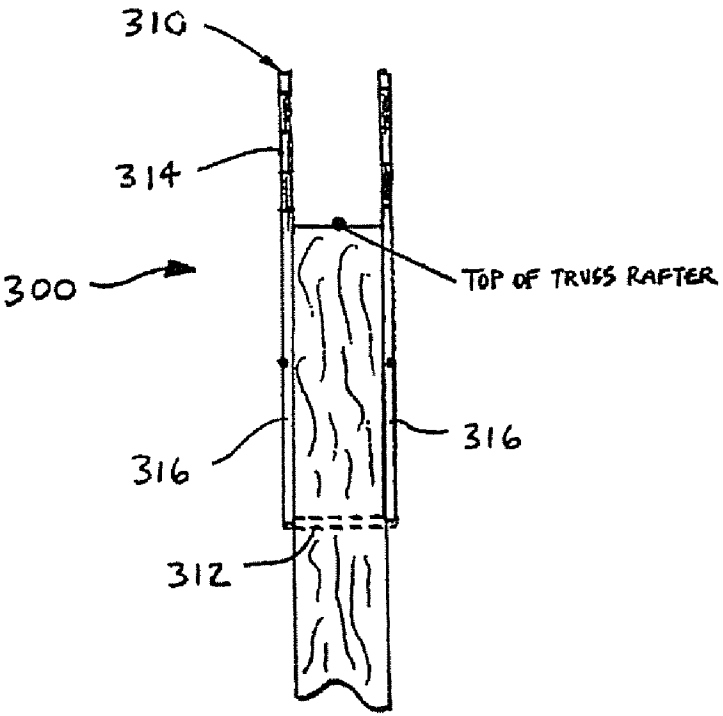
FIG. 11 is a side view of the double gusset of FIG. 10 shown attached to a truss rafter.
Figure 10:
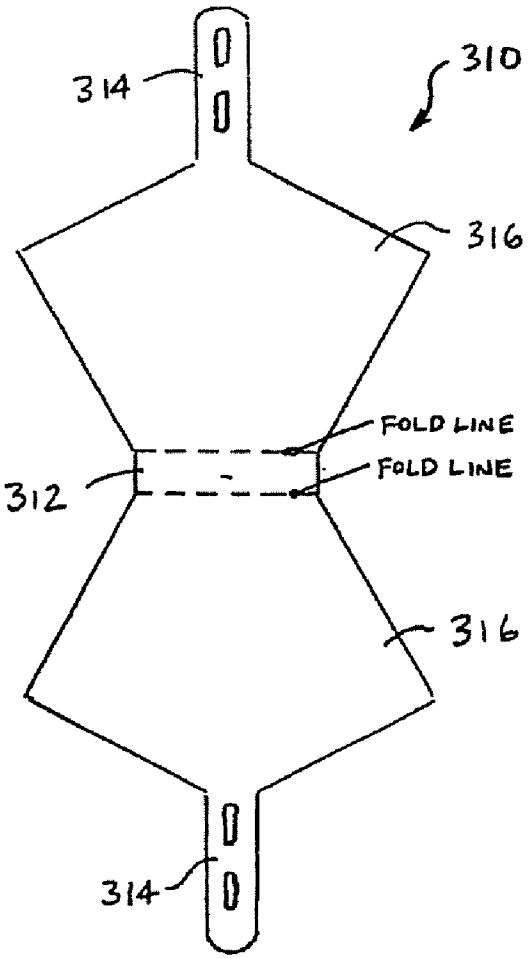
FIG. 10 is a front view of another embodiment of the peak gusset of the present invention shown in a single piece configuration.
Figure 12:
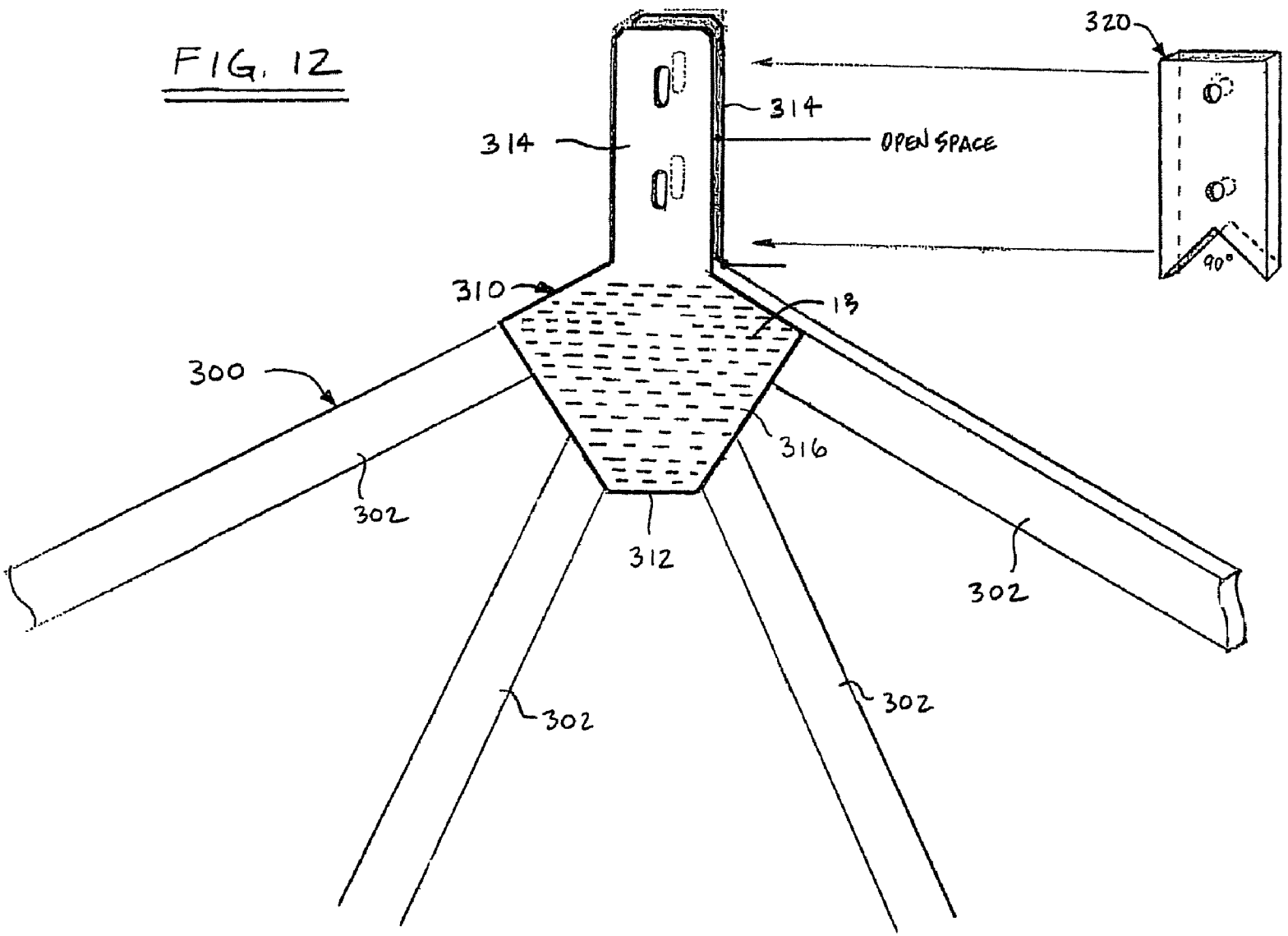
FIG. 12 is a partial perspective view of a truss formed with the double peak gusset of FIG. 10 and a support ferrule of FIG. 6 shown exploded therefrom.

Referring now to FIG. 10, another embodiment of a double peak gusset 310 is shown having a connection portion 312 between the plate portions 316 of the double gusset 310. A plurality of teeth (not shown) extend perpendicularly from each plate portion 316.*s* The double peak gusset 310 is folded on either end of connection portion 312 and attached to form truss 300 by the plurality of teeth (not shown) engaging the truss members 302 as shown in FIGS. 11 and 12. The attached peak gusset 310 is shown in a partial perspective view in FIG. 12. The peak gusset plate portions 316 remain connected by connection portion 312. A support ferrule insert 320 is shown as insertable between the anchor portions 314 as shown in previous embodiments.

Figure 13:
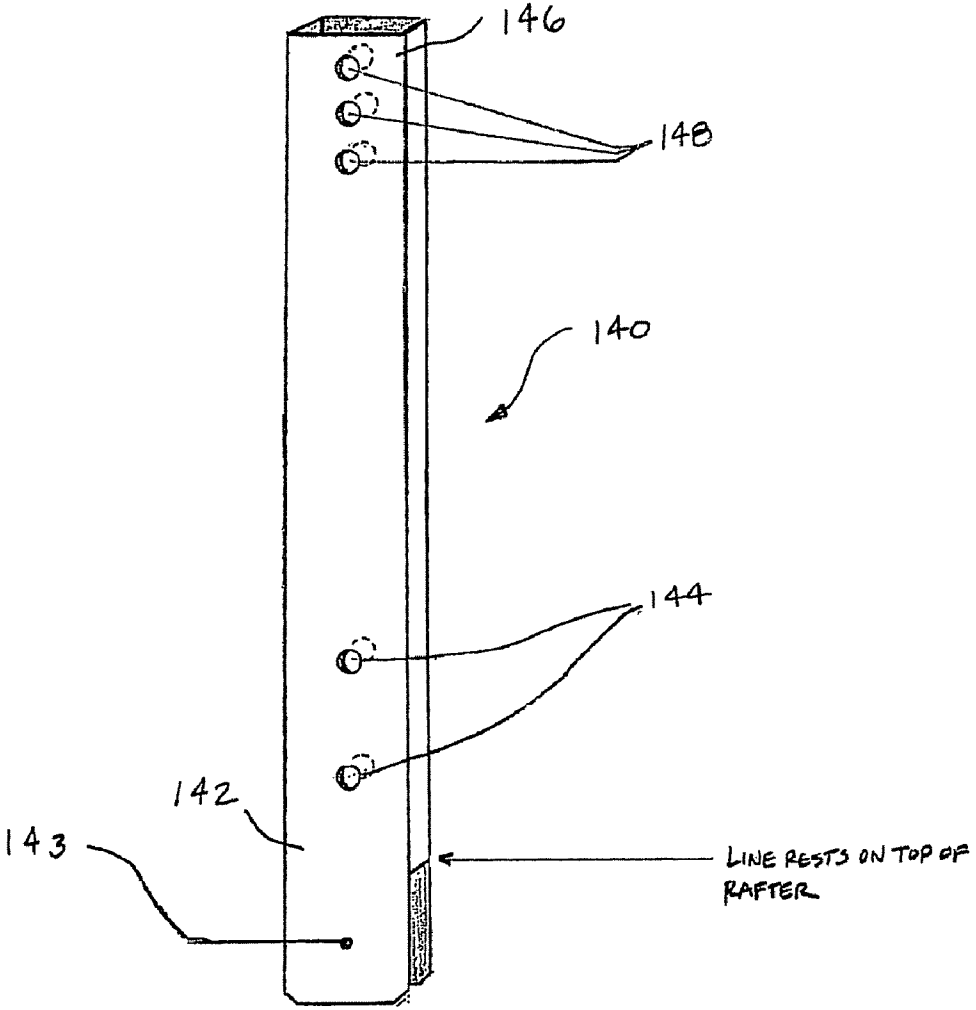
FIG. 13 is a perspective view of another embodiment of the high reach accessory of the roof anchor system of the present invention.
Figure 14:
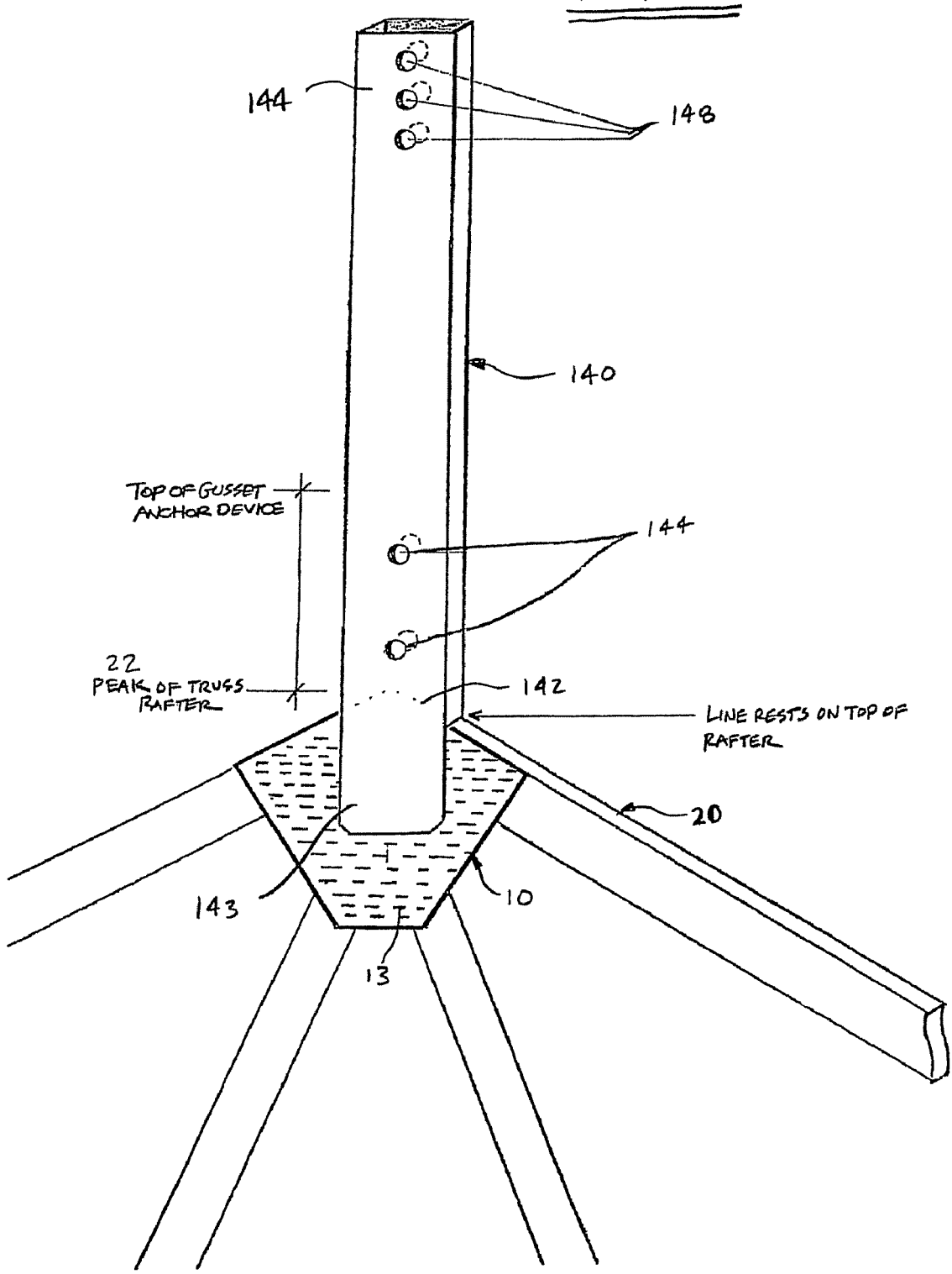
FIG. 14 is a perspective view of a high reach accessory of FIG. 13 shown attached over a portion of a truss using the peak gusset of the present invention.

A variation of the high reach accessory 140 is shown in FIG. 13. The high reach accessory 140 is similar to the previous embodiment of the high reach accessory 40 except that it has a rectangular tubular cross-section as opposed to a square cross-section, and apertures 144 and the first end 142 are circular as opposed to slots. The invention is not limited to a particular configuration of the high reach accessory 40, 140. As with the previous embodiment, the high reach accessory 140 also may include sidewall extensions 143 that extend over the sides of the truss peak 22 to provide additional stability and prevent low-impact side-to-side collapse of the anchor portions 14 of the gussets 10 as best shown in FIG. 14. The first end 142 fits over the anchor portions 14. As with the previous embodiment, the opposite end 1456 of the high reach accessory 140 includes attachment means 148 for attachment of other safety items, the attachment means 148 shown herein as a plurality of apertures 148.

Figure 15:
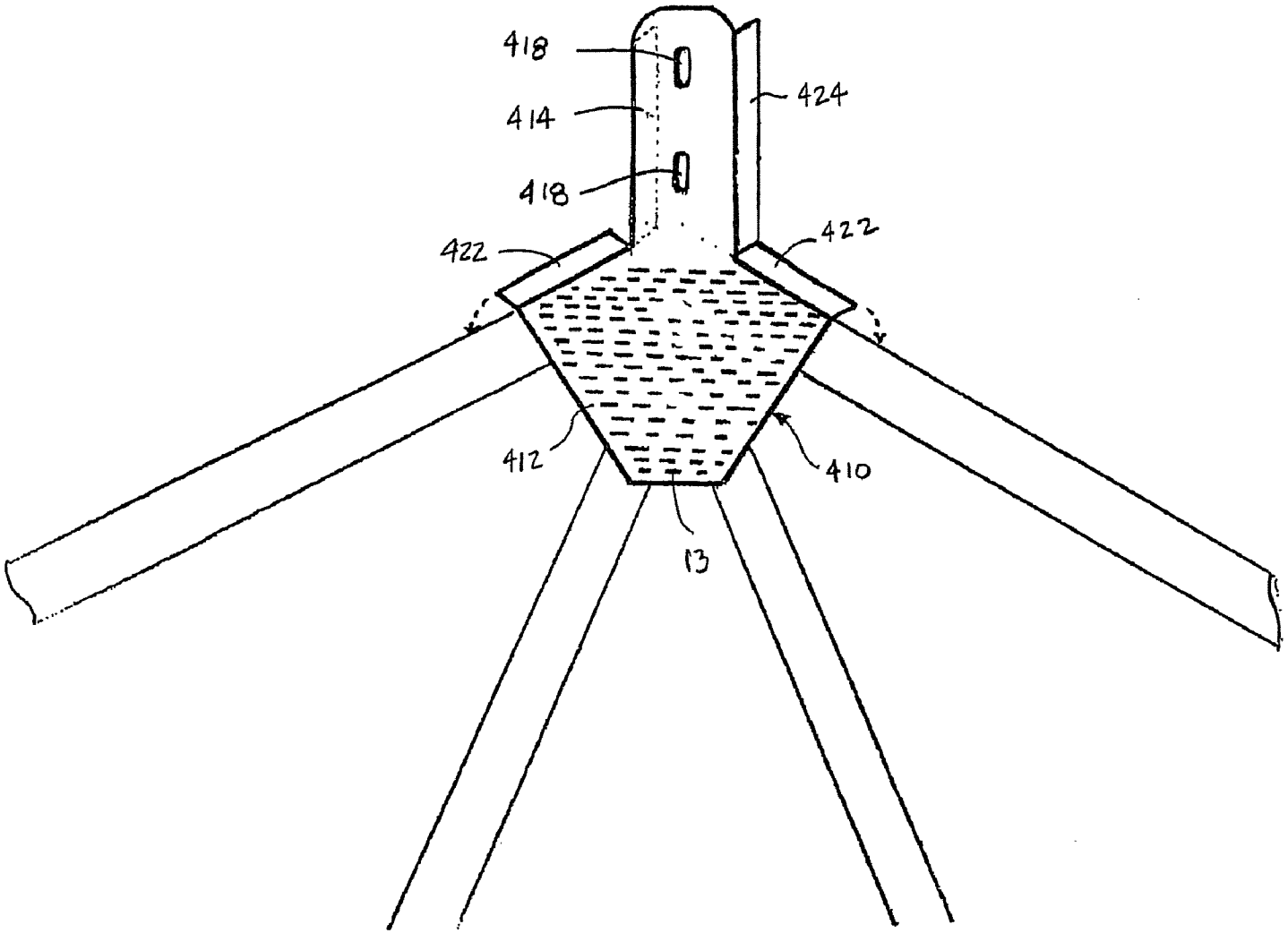
FIG. 15 is a partial perspective view of another embodiment of the peak gusset having fold over side reinforcements, shown attached to a plurality of truss rafters and truss webs.

Another embodiment of the peak gusset 410 is shown in FIG. 15. The peak gusset comprises a plate 412 of steel having a plurality of teeth (not shown) formed from the plate and extending perpendicularly from the plate 412. The peak gusset 410 further comprises an anchor portion 414 extending from the peak side of the gusset 410. The anchor portion 414 includes a means for attachment 418 of other safety items, the attachment means shown herein as a pair of apertures 418. Gusset 410 includes reinforcing flaps 424 extending from the anchor portion 414 and reinforcing flaps 422 extending from the plate 412. When a peak gusset 410 is attached to either side of a truss 400, the flaps 424, 422 of each gusset are folded perpendicular to their respective gussets 410 and provide additional support for the anchor portion 414. A support ferrule insert (not shown) may still be used. If needed, and is insertable through an opening at the top of the anchor portions 414 of the gussets 410.

Figure 16:
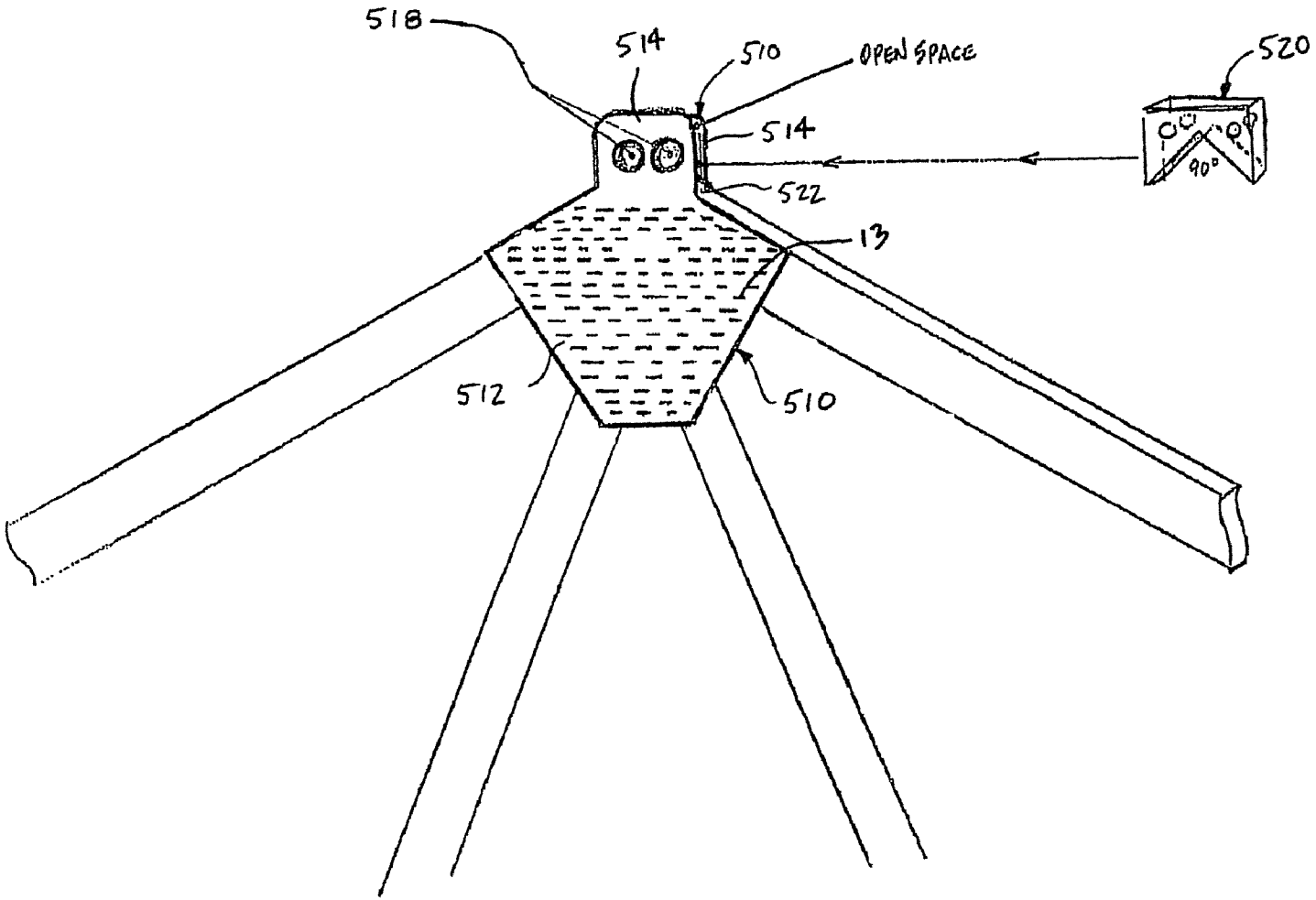
FIG. 16 is a partial perspective view of another embodiment of the peak gusset having a low profile attachment extension, shown attached to a plurality of truss rafters and truss webs.
Figure 17:
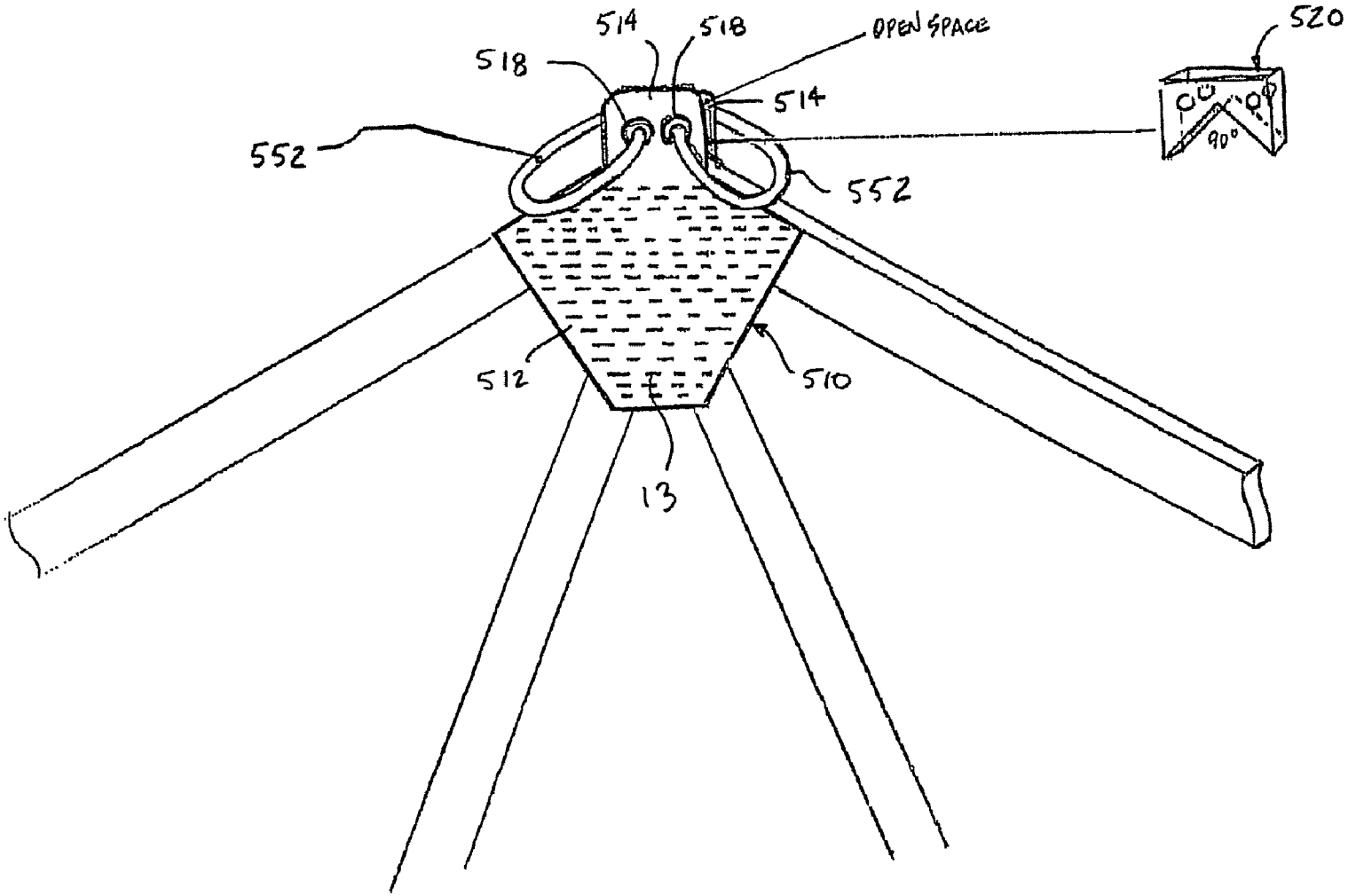
FIG. 17 is a partial perspective view of the peak gusset as shown in FIG. 16 having a plurality of D rings attached thereto as a cable harness hook up.

Another embodiment of the peak gusset 510 is shown in FIGS. 15 and 16. The peak gusset comprises a plate 512 of steel having a plurality of teeth (not shown) formed from this plate and extending perpendicularly from the plate 512. The peak gusset 510 further comprises an anchor portion 514 extending from the peak side of the gusset 510. The anchor portion 514 includes a means for attachment 518 of other safety items, the attachment means shown herein as a pair of apertures 518. A peak gusset 510 is attached to either side of a truss peak 522. A support ferrule 520 is shown as insertable between the anchor portions 514 as shown in previous embodiments. In FIG. 17, a pair of D-rings 552 is shown attached to the peak gussets 510.

Figure 19:
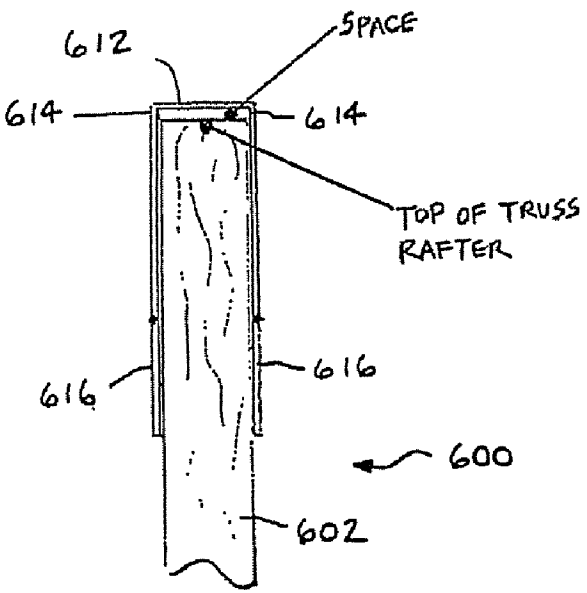
FIG. 19 is a side view of the peak gusset of FIG. 18, shown attached to a truss rafter.
Figure 18:
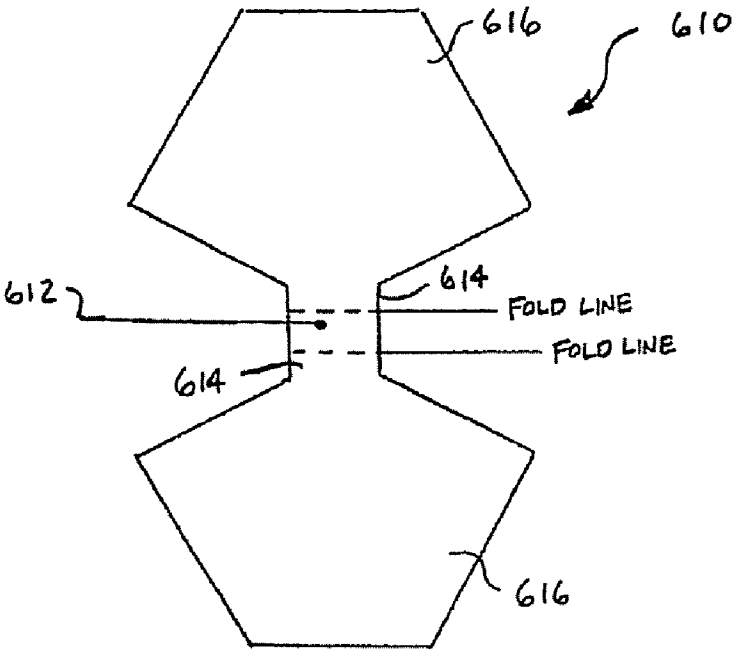
FIG. 18 is a front view of a low anchor profile embodiment of the peak gusset of the present invention shown in a single piece configuration.
Figure 20:
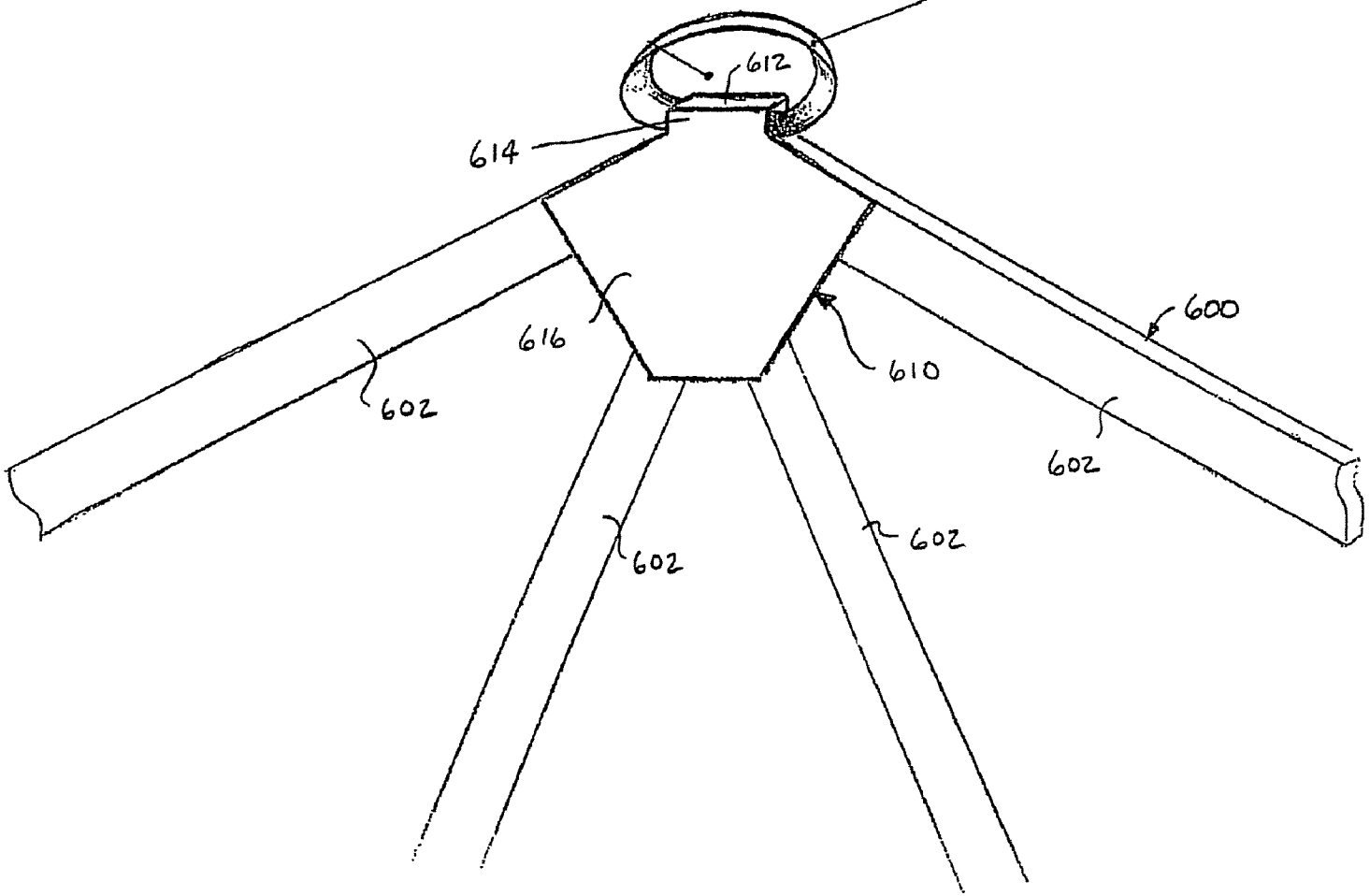
FIG. 20 is a partial perspective view of a truss formed with the peak gusset of FIG. 18 shown with a metal loop.
Figure 21:
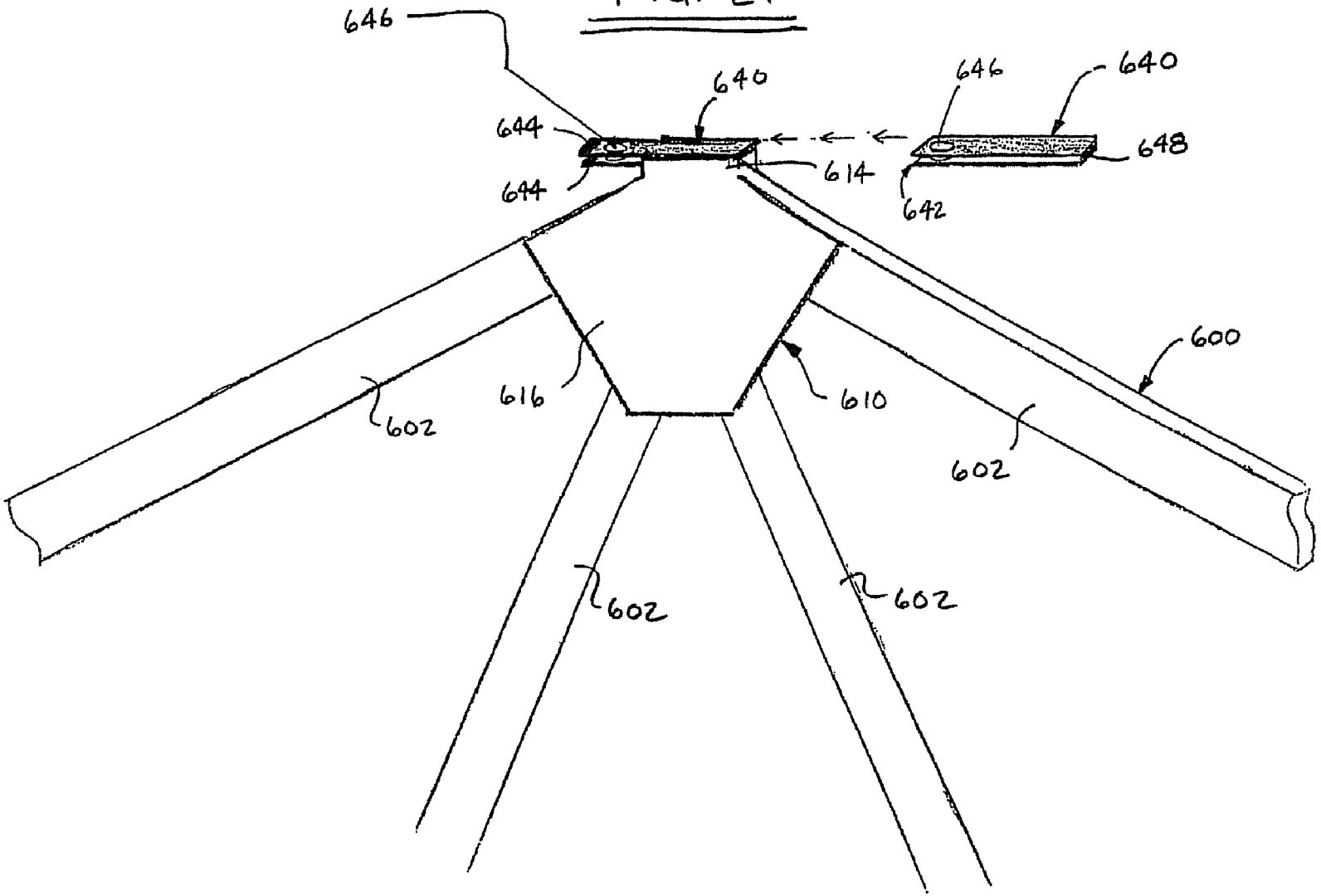
FIG. 21 is a partial perspective view of a truss formed with the peak gusset of FIG. 18 shown with a side clip.

The peak gussets 10, 210, 310, 410, and 510 all have a significant extension of the anchor above the truss. The peak gusset of the present invention may also be configured in a "low profile" configuration. Referring now to FIGS. 18 and 19, a double peak gusset 610 is shown that is manufactured as one piece and then folded prior to attachment to form the truss 600. Double peak gusset 610 comprises a connection portion 512 between the anchor portions 614 of the double gusset 610. A plurality of teeth (not shown) extends perpendicularly from each plate portion 616. The double peak gusset 510 is folded on either end of connection portion 512 and attached to form a truss 600 by the plurality of teeth (not shown) engaging the truss member 512 as shown in FIG. 19 such that the connection portion 612 forms a cap over the anchor portions 614. The peak gusset anchor portions 615 only extend a short distance above the peak of the truss 600 and remain connected by connection portion 612, providing enhanced strength. The attached peak gusset 610 is shown in a partial perspective view in FIG. 20 including a metal loop 630 which provides an attachment location for a harness cable hook up (not shown). Another variation is shown in FIG. 21 where a slide clip 640 is used to provide an attachment location for a harness cable hook up (not shown). Slide clip 640 is a U-shaped metal band. Connection portion 5612 of the peak gusset 510 is positioned between the legs 544 of the open end 642 of slide clip 640. Apertures 646 in the legs 644 of clip 540 provide an attachment location for a harness cable hook up. The harness cable hook up and the closed end 648 of the slide clip 640 act to secure the slide clip to the peak gusset 510. The low profile of the anchor portions 6145 and connection portion 612 make it so that they can remain in place and simply be covered by the roof peak (not shown) or by ridge shingles. Alternatively, the anchor portions 614 and connection portion 612 can be removed or bent out of the way as in previous embodiments.

Figure 23:
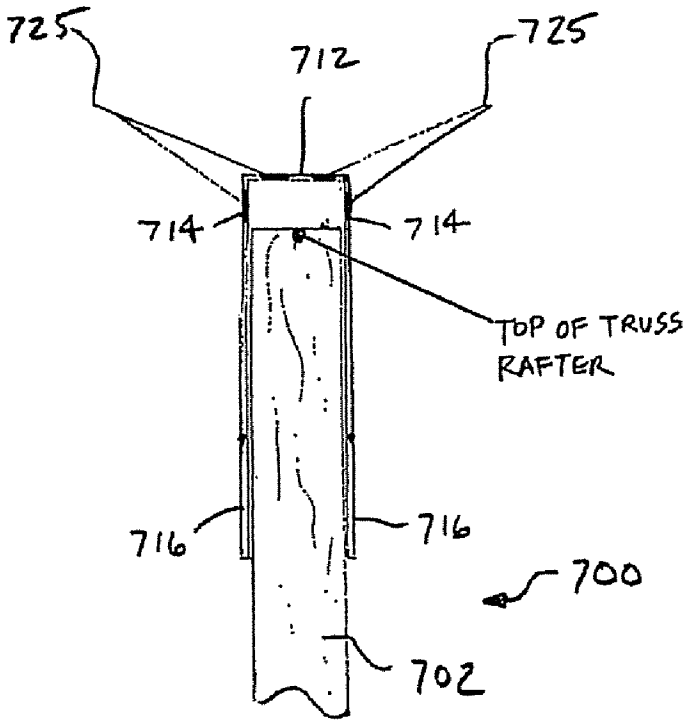
FIG. 23 is a side view of peak gusset of FIG. 22, shown attached to a truss rafter.
Figure 22:
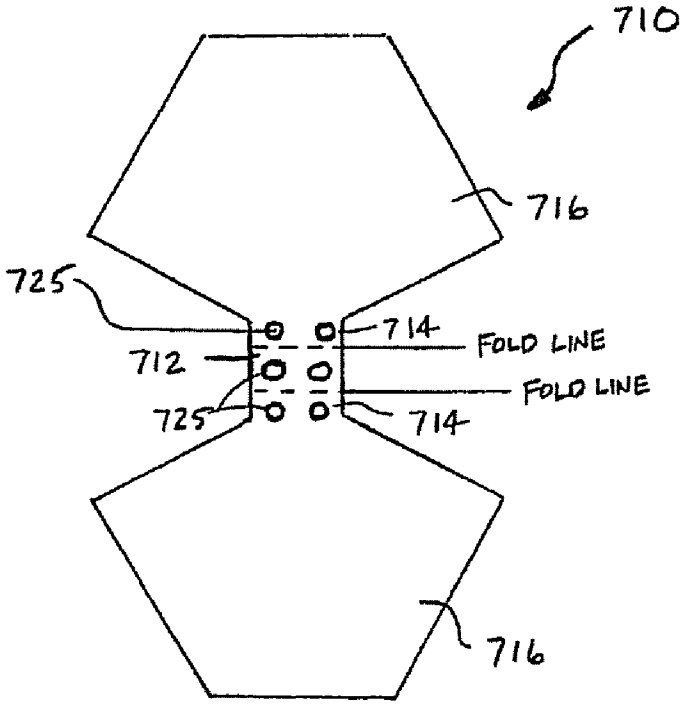
FIG. 22 is a front view of a second low anchor profile embodiment of the peak gusset of the present invention shown in a single piece configuration.
Figure 24:
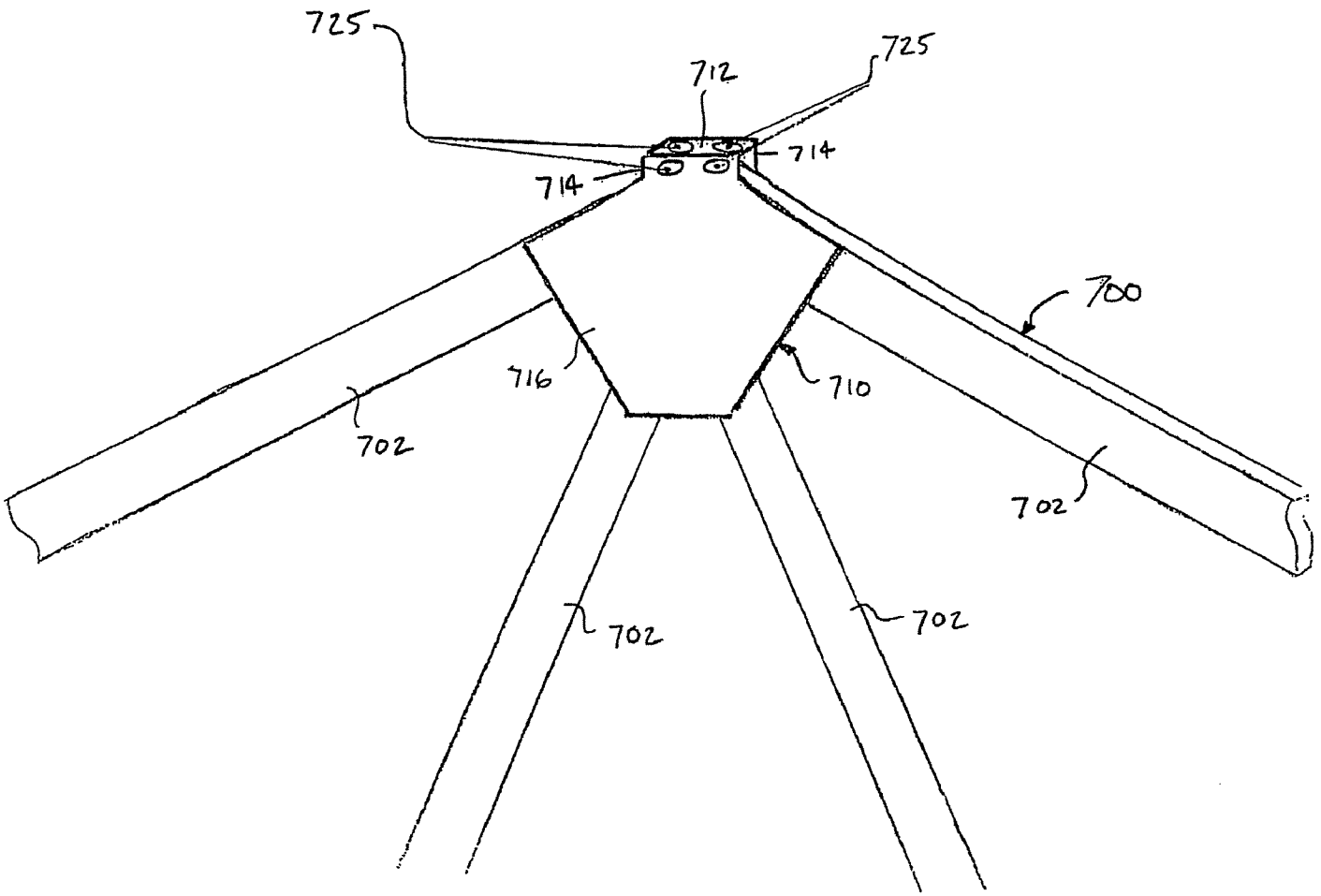
FIG. 24 is a partial perspective view of a truss formed with the peak gusset of FIG. 22.

Referring now to FIGS. 22 and 23, a second embodiment of a low profile double peak gusset 710 is shown. Peak gusset 710 is manufactured as one piece and then folded prior to attachment to form truss 700. Double peak gusset 710 comprises a connection portion 712 between the anchor portions 714 of the double gusset 710. A plurality of teeth (not shown) extends perpendicularly from each plate portion 716. A plurality of apertures 725 are formed in the anchor portions 714 and/or the connection portion 712. The double peak gusset 710 is folded on either end of connection portion 712 and attached to form a truss 700 by the plurality of teeth (not shown) engaging the truss member 712 as shown in FIG. 24. Apertures 725 provide an attachment location for a harness cable hook up. As with the previous embodiment, the low profile of the anchor portions 714 and connection portion 712 make it so they can remain in place and simply be covered by the roof peak vent (not shown) or ridge shingles. Alternatively, the anchor portions 714 and connection portion 712 can be removed or bent out of the way as in previous embodiments.

Figure 27:
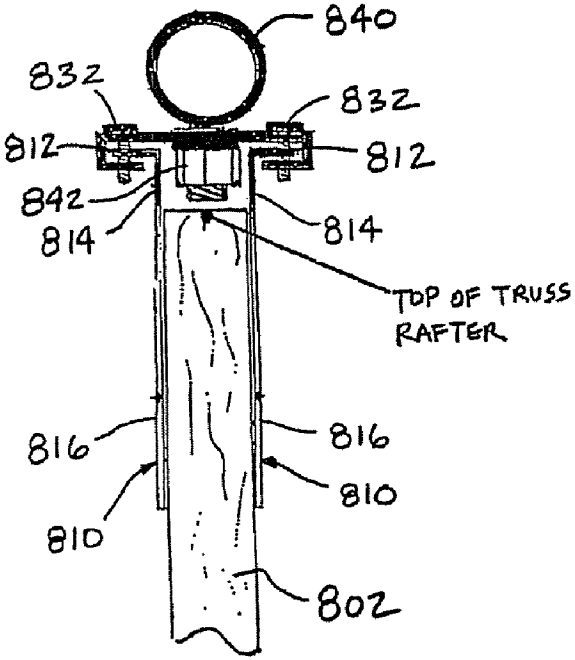
FIG. 27 is a side view of the peak gusset of FIG. 25, shown attached to a truss rafter with a slide-on eyebolt base and eyebolt attached to the peak gusset.
Figure 26:
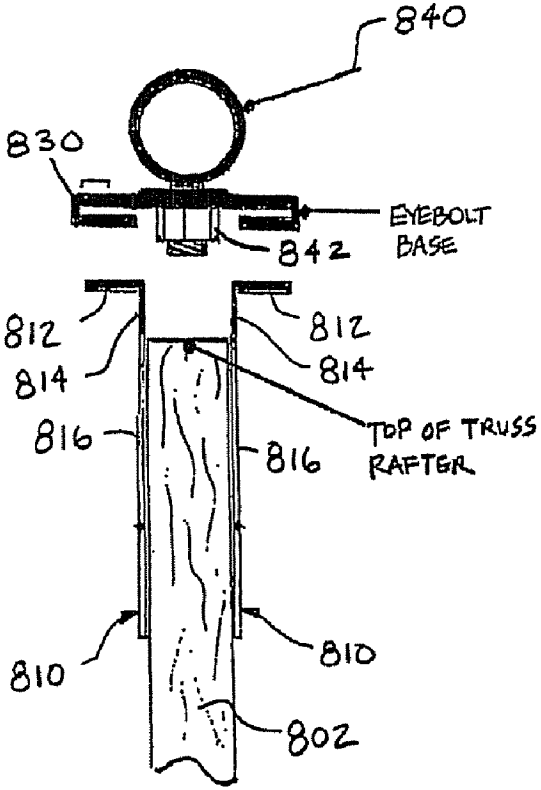
FIG. 26 is a side view of the peak gusset of FIG. 25, shown attached to a truss rafter with an unattached slide-on eyebolt base and eyebolt.
Figure 25:
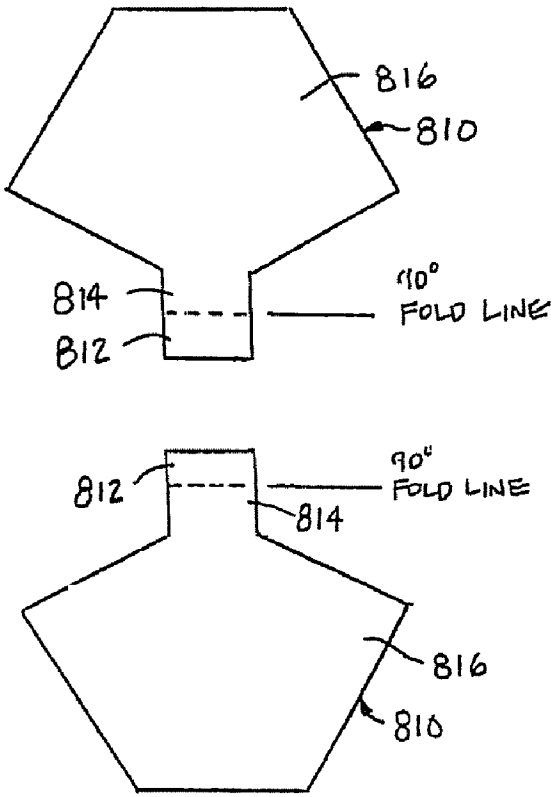
FIG. 25 is a front view of another embodiment of the peak gusset of the present invention.
Figure 28:
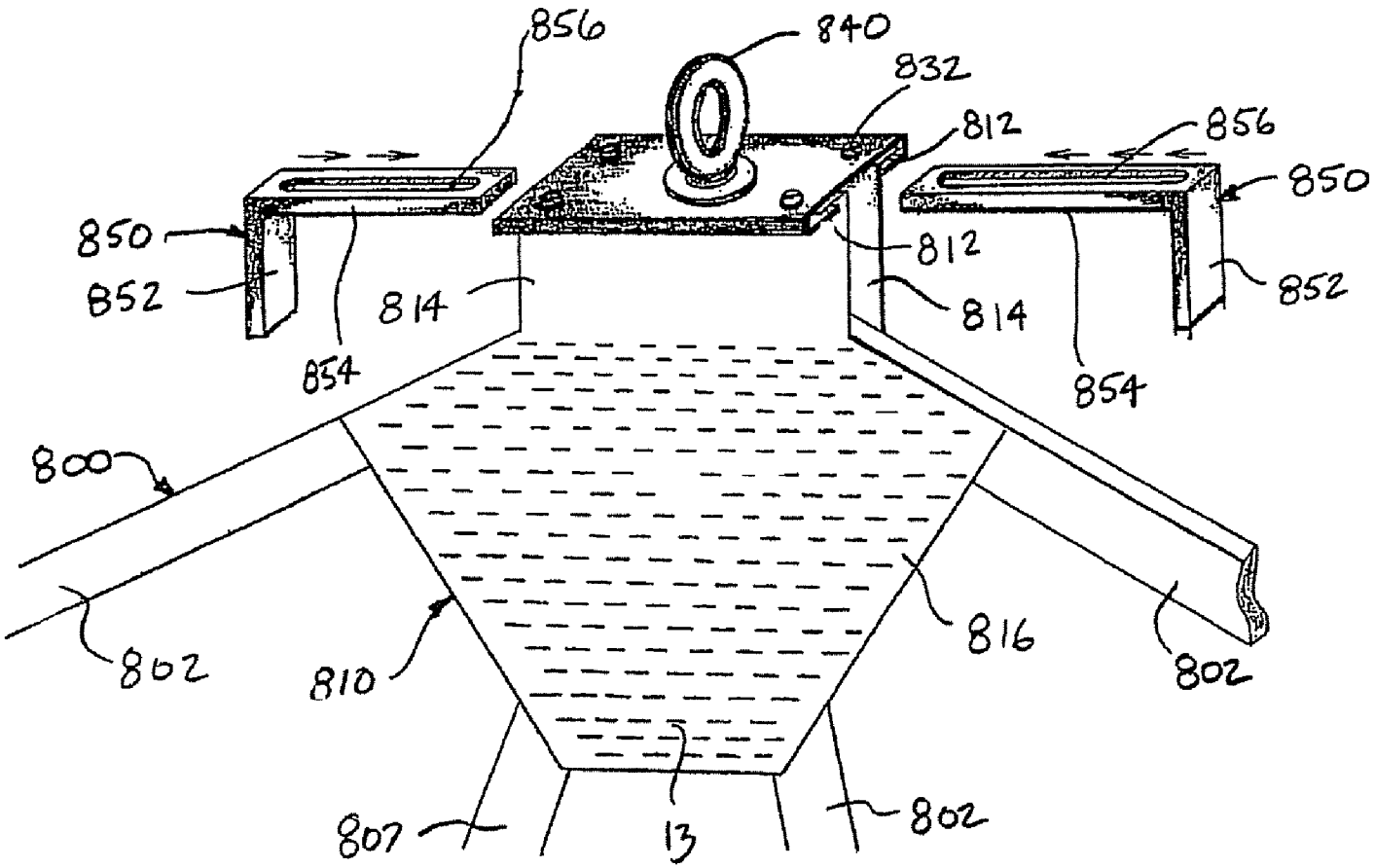
FIG. 28 is a partial perspective view of a truss formed with the peak gusset of FIG. 27 shown with a plurality of support members shown exploded therefrom.

Referring now to FIGS. 25-28, another embodiment of the peak gusset 810 is shown. Peak gusset 810 comprises a plate portion 816 and an anchor portion 814 extending therefrom and having a connection portion 812. A plurality of teeth (not shown) extends perpendicularly from each plate portion 816. The gusset plates 810 are attached to form a truss 800 by the plurality of teeth (not shown) engaging the truss members 802 as shown in FIG. 26. The connection portions 812 are folded outward from the anchor portion 814 of the gusset plates 810 to form a connection flange for a slide-on eyebolt base 830 having an eyebolt 840 attached thereto by a fastener 842. The eyebolt base 830 is slid over flanges 812 and secure thereto with a plurality of fasteners 832 as shown in FIG. 27. The attached peak gusset 810 is shown I a partial perspective view in FIG. 28 attached to truss 800. In order to provide additional strength for the eyebolt connection 840, a pair of support angles 850 is provided. The support angles 850 are designed such that the legs 854 next one under the other. A slot 856 is formed in the legs 854 to allow the shaft of the eyebolt 840 to pass through. The support angles 850 are fixed in position by eyebolt 840 and fastener 842.

Figure 30:
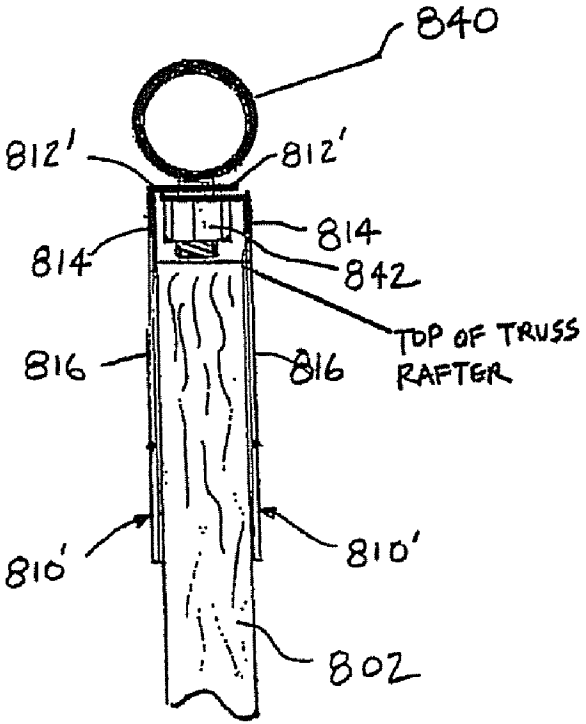
FIG. 30 is a side view of the peak gusset of FIG. 29, shown attached to a truss rafter with an eyebolt attached to the peak gusset.
Figure 29:
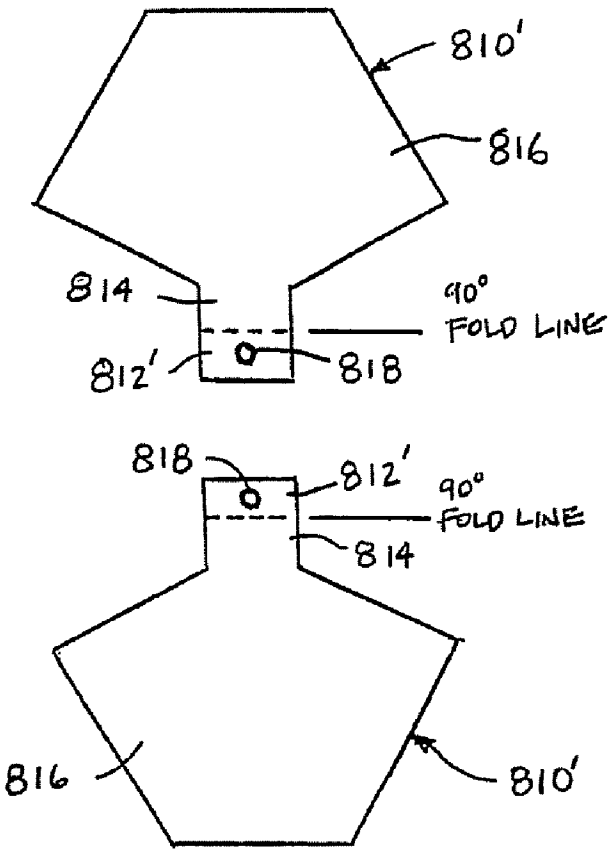
FIG. 29 is a front view of another embodiment of the peak gusset of the present invention similar to the embodiment of FIG. 25.
Figure 31:
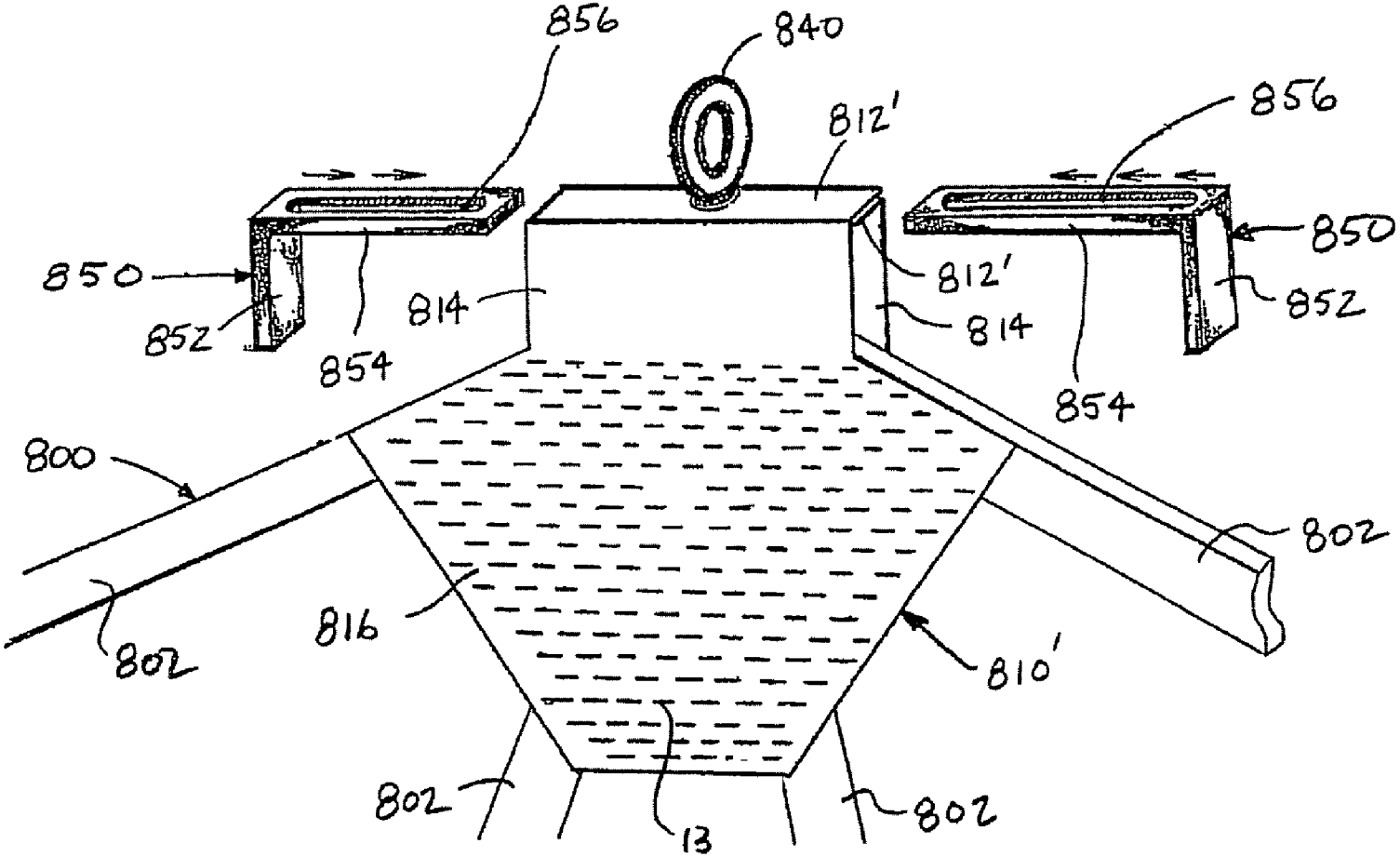
FIG. 31 is a partial perspective view of a truss formed with the peak gusset of FIG. 30 shown with a plurality of support members shown exploded therefrom.

Another variation of this embodiment is shown in FIGS. 29-31. In the embodiment shown in FIG. 29 the gusset plate 810' have an aperture 818 formed in connection portion 812'. As with the previous embodiment, the gusset plate 810' are attached to form a truss 800 by the plurality of teeth (not shown) engaging the truss member 802 as shown in FIG. 30. However, the connection portions 812' are folded inward from the anchor portions 814 of the gusset plate 810' such that the apertures 818 are aligned to allow the shaft of eyebolt 840 to pass and for the eyebolt 840 to be directly attached to the connection portion 812' by a fastener 842. The attached peak gusset 810' is shown in a partial perspective view in FIG. 31 attached to truss 800. In order to provide additional strength for the eyebolt connection 840, the pair of support angle 850 is provided as previously discussed and shown in FIG. 28.

Figure 33:
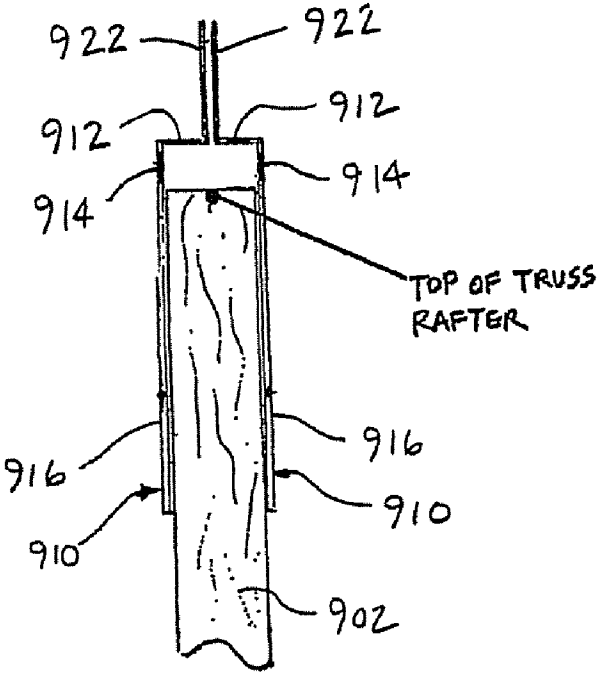
FIG. 33 is a side view of the peak gusset of FIG. 32, shown attached to a truss rafter.
Figure 32:
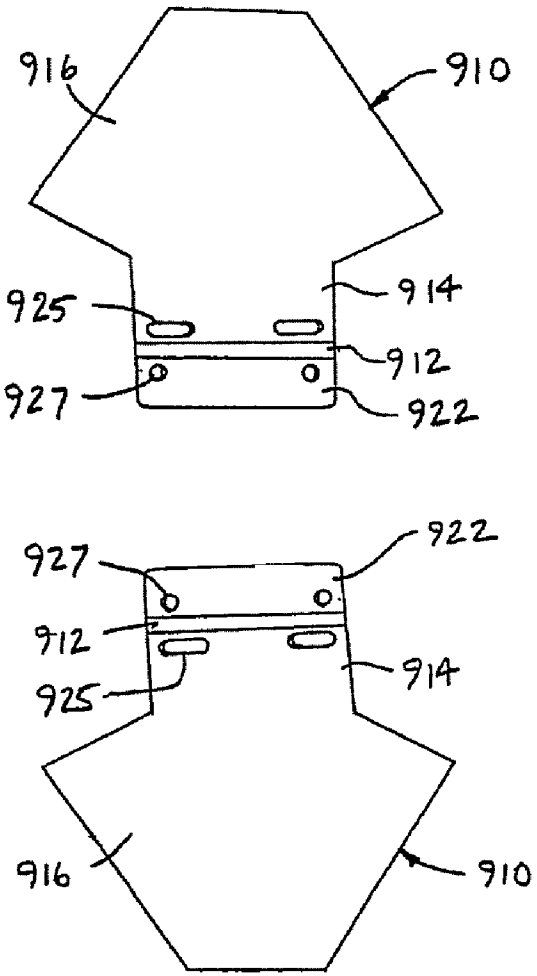
FIG. 32 is a front view of another embodiment of the peak gusset of the present invention utilizing gusset plates with a double fold.
Figure 34:
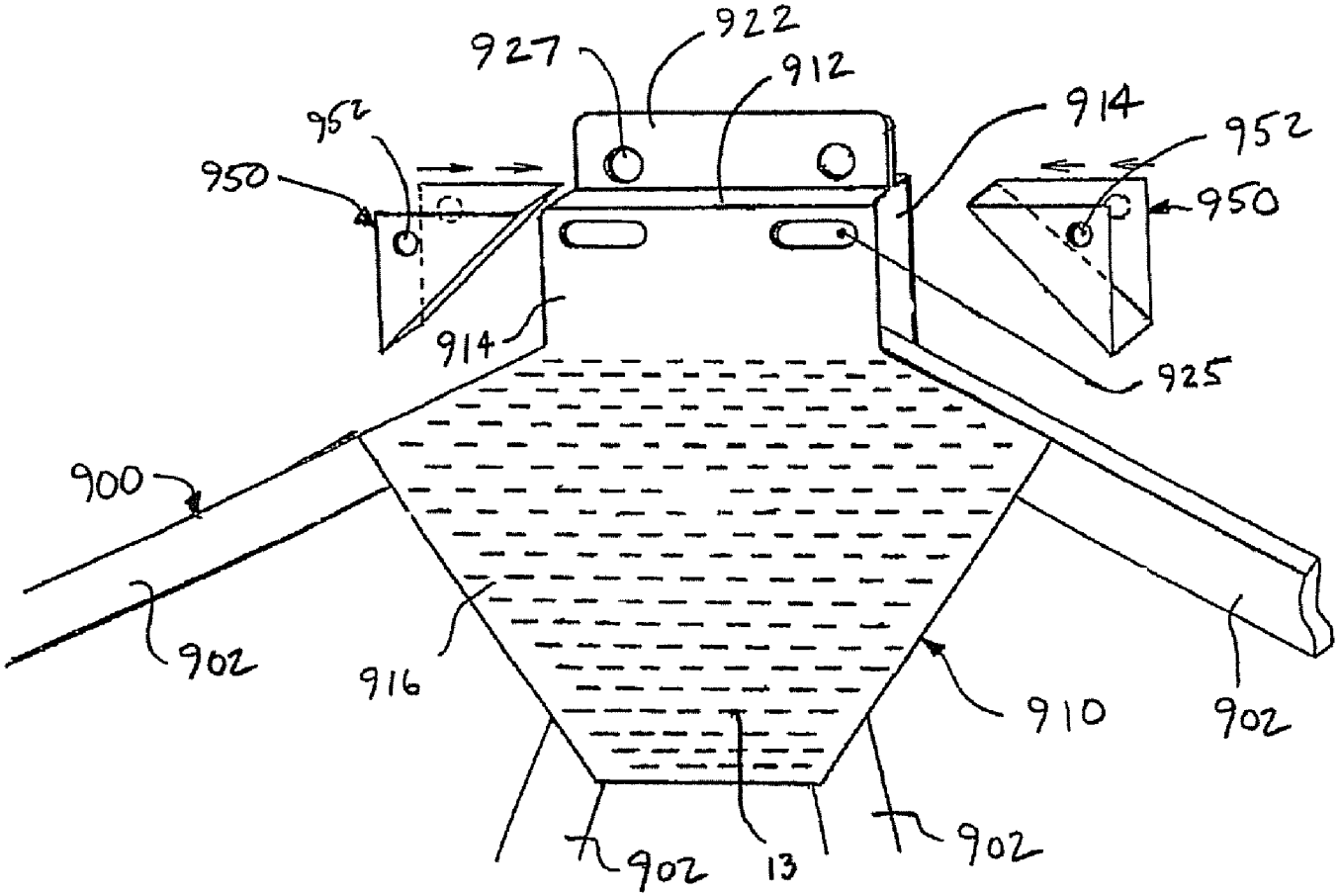
FIG. 34 is a partial perspective view of a truss formed with the peak gusset of FIG. 32 shown with a plurality of support members shown exploded therefrom.

Referring now to FIGS. 32-34, another embodiment of the peak gusset 910 is shown. As shown in FIG. 32, a pair of peak gussets 910 each comprises a plate portion 916 and an anchor portion 914 extending therefrom and having a connection portion 922 having at least one aperture 927 and a shoulder portion 912 having at least one aperture 925. A plurality of teeth (not shown) extends perpendicularly from each plate portion 915. The gusset plates 910 are attached to form a truss 900 by the plurality of teeth (not shown) engaging the truss member 902 as shown in FIG. 33. The shoulder portions 912 are folded inward from the anchor portion 914 of the gusset plates 910 and connection portion 922 are folded away from anchor portion 914 such that connection portion 922 and anchor portion 914 are generally parallel to each other. The attached peak gussets 910 are shown in a partial perspective view in FIG. 34 attach to truss 900. In order to provide additional strength for the anchor portion 912, a pair of support block wedges 950 is provided. The support blocks 950 each are configured to engage the top of the rafter 902 and the interior of shoulder portion 912. The support blocks 950 include an aperture 952 that is aligned with aperture 925 of the anchor portion to allow the support block 950 to be fastened to the gusset plates 910 by a fastener (not shown). The apertures 927 in the connection portion 922 provide anchor connection locations for users. It is noted that the support block edge 950 is shown with open sides and a closed bottom. This allows access such that the hard shaft of the support block fastener can be used as an alternative hook location for the safety line carabiner.

Figure 36:
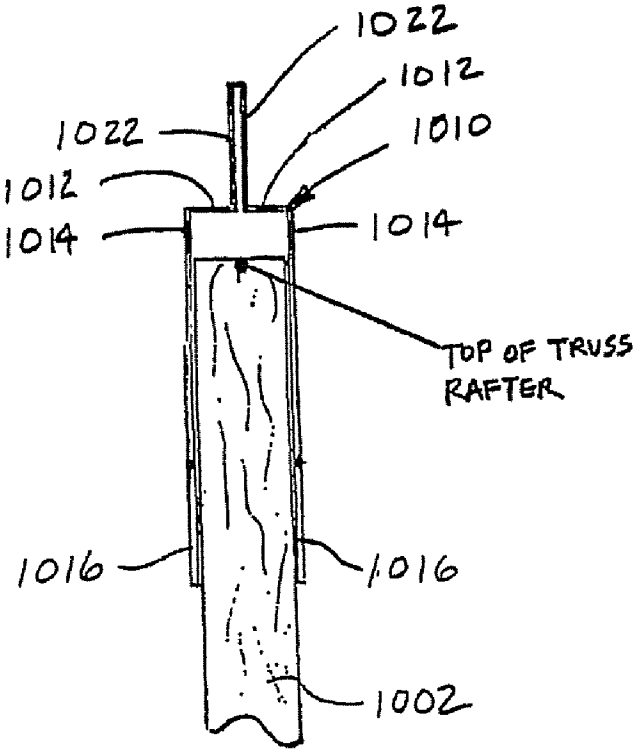
FIG. 36 is a side view of the peak gusset of FIG. 35, shown attached to a truss rafter.
Figure 35:
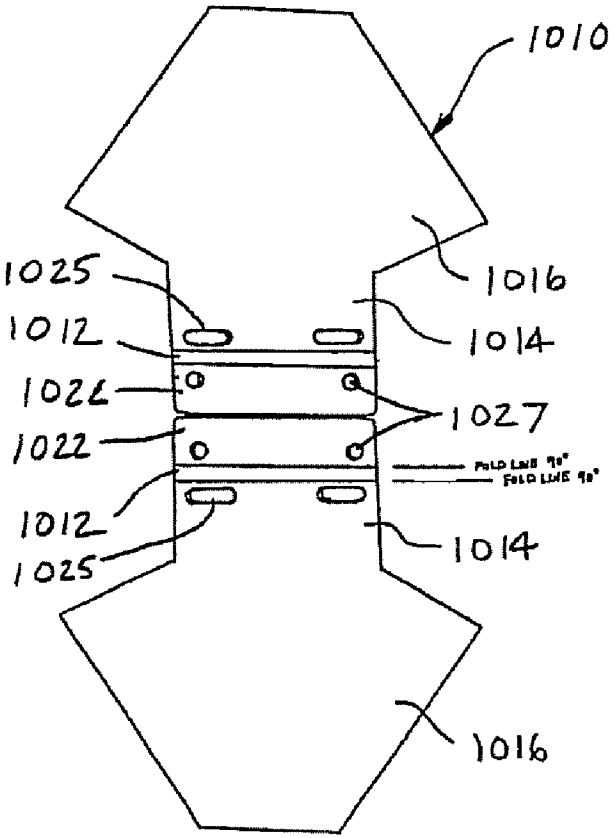
FIG. 35 is a front view of another embodiment of the peak gusset of the present invention, which is a one-piece version of the gusset plate of FIG. 32.

Another embodiment of the invention is shown in FIGS. 35 and 36 and is a double gusset version of the embodiment shown in FIGS. 32-34. A double peak gusset 1010 is shown that is manufactured as one piece and then folded prior to attachment to form the truss. Double peak gusset 1010 comprises a pair of shoulder portions 1012 and a pair of connection portions 1022 each having at least one aperture 1027, between the anchor portions 1014 of the double gusset 1010. The shoulder portions 1012 are folded inward from the anchor portions 1014 of the double gusset plate 1010 and connection portions 1022 are folded away from anchor portions 1014 such that connection portions 1022 and anchor portion 1014 are generally parallel to each other. A plurality of teeth (not shown) extends perpendicularly from each plate portion 1016. The double peak gusset 1010 is folded and attached to form a truss by the plurality of teeth (not shown) engaging the truss members 1002 as shown in FIG. 36. As with the previous embodiment, it is contemplated that support blocks 950 could be used to strengthen the anchor portion 1014.

Figure 37:
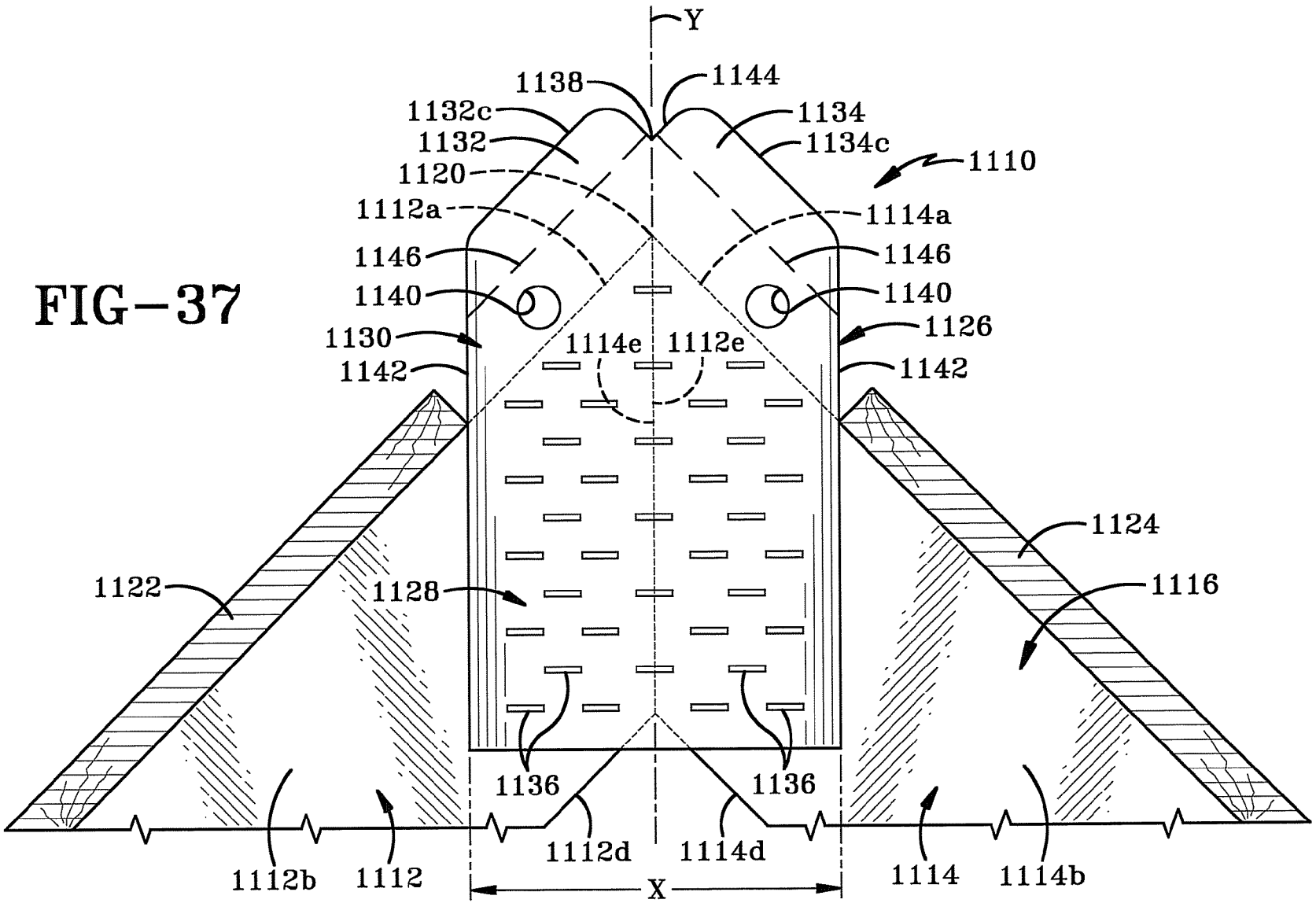
FIG. 37 is a front view of another embodiment of the peak gusset of the roof anchor system of the present invention shown attached to a truss with the peak of the truss shown in phantom and sheet material secured to the truss.

Referring to FIGS. 37-41, there is shown yet another embodiment of a peak gusset plate in accordance with the present invention and generally indicated at 1110. Peak gusset 1110 is designed to be permanently and non-removably secured to a roof truss at a manufacturing facility. The roof truss so formed includes a permanently available anchoring member for a security line for a workman. FIG. 37 shows the uppermost region of a first roof truss 1116 that includes a first truss member 1112 and a second truss member 1114. First truss member 1112 has an upper surface 1112*a*, a side surface 1112*b*, an opposed second side surface 1112*c*, a bottom surface 1112*d*, and an angled end 1112*e*. Second truss member 1114 has an upper surface 1114*a*, a side surface 1114*b*, a second side surface 1114*c*, a bottom surface 1114*d*, and an angled end 1114*e*. Angled ends 1112*e*, 1114*e* are placed in abutting contact with each other so that first and second truss members 1112, 1114 form an apex or peak 1120. The peak gusset 1110 in accordance with the present invention is secured to a portion of side surface 1112*b* of first truss member 1112 and to a portion of side surface 1114*b* of second truss member 1114 adjacent the peak 1120 as will be hereinafter described. It will be understood, however, that truss 1116 may be constructed differently, such as having a molded top portion, which includes the peak 1120, and a plurality of truss members extending from this molded top portion.

In accordance with the present invention, peak gusset 1110 comprises a substantially planar steel plate 1126 that includes an attachment region 1128 and an anchor portion 1130. Peak gusset 1110 may also include a pair of flaps 1132, 1134 which may be provided to increase the strength of peak gusset 1110 and aid in preventing injury to persons working on the roof. Flaps 1132, 1134 may be omitted if the steel plate 1126 is of sufficient strength to support a security line. Attachment region 1128, anchor portion 1130 and flaps 1132, 1134 are integrally formed and coplanar with each other. Attachment region 1128 includes a plurality of gripping teeth that extend outwardly from a rear surface thereof and are disposed substantially at right angles thereto. The number 1136 in the attached figures indicates the region of teeth 1136 as seen from the front of peak gusset 1110 when attached to first roof truss 1116. Teeth 1136 are substantially identical to teeth 13 and are pressed into portions of side surfaces 1112*b*, 1114*b* during construction of truss 1116.

Anchor portion 1130 of peak gusset 1110 is integral with and extends outwardly away from attachment region 1128 and preferably is coplanar with attachment region 1128. Anchor portion 1130 preferably is generally triangular in shape, terminating in an apex 1138 that is aligned with peak 1120 of first truss 1116. Peak gusset 1110 has a longitudinal axis "Y" that extends through apex 1138 and is designed to be aligned with the abutting angled ends 1112*e*, 1114*e* of first and second truss members 1112, 1114. Anchor portion 1130 extends laterally outwardly away from peak 1120 as shown in FIG. 37 and may also extend vertically beyond peak 1120. Anchor portion 1130 preferably has an upper section that is substantially free of teeth or has minimal numbers of teeth. This upper section is designed to be disposed laterally above upper surfaces 1112*a*, 1114*a*. Anchor portion 1130 may extend vertically above and laterally outwardly beyond peak 1120 and therefore is not and does not need to be directly secured to first roof truss 1116 other than by way of attachment region 1128.

In accordance with a specific feature of the present invention, a pair of holes 1140 is defined in the upper section of anchor portion 1130. Holes 1140 are spaced a distance horizontally apart from each other and a short distance inwardly of side edges 1142 of anchor portion 1130. Holes 1140 are also spaced a distance inwardly from flaps 1132, 1134. Holes 1140 are aligned with each other and are disposed along a horizontal axis that is at right angles to the longitudinal axis "Y" of peak gusset 1110. Holes 1140 are positioned so that when attachment region 1128 is secured to truss 1116, holes 1140 will be positioned vertically above upper surfaces 1112*a*, 1114*a* of the first and second truss members 1112, 1114 and vertically beneath the apex 1120 of first truss 1116.

Figure 38A:
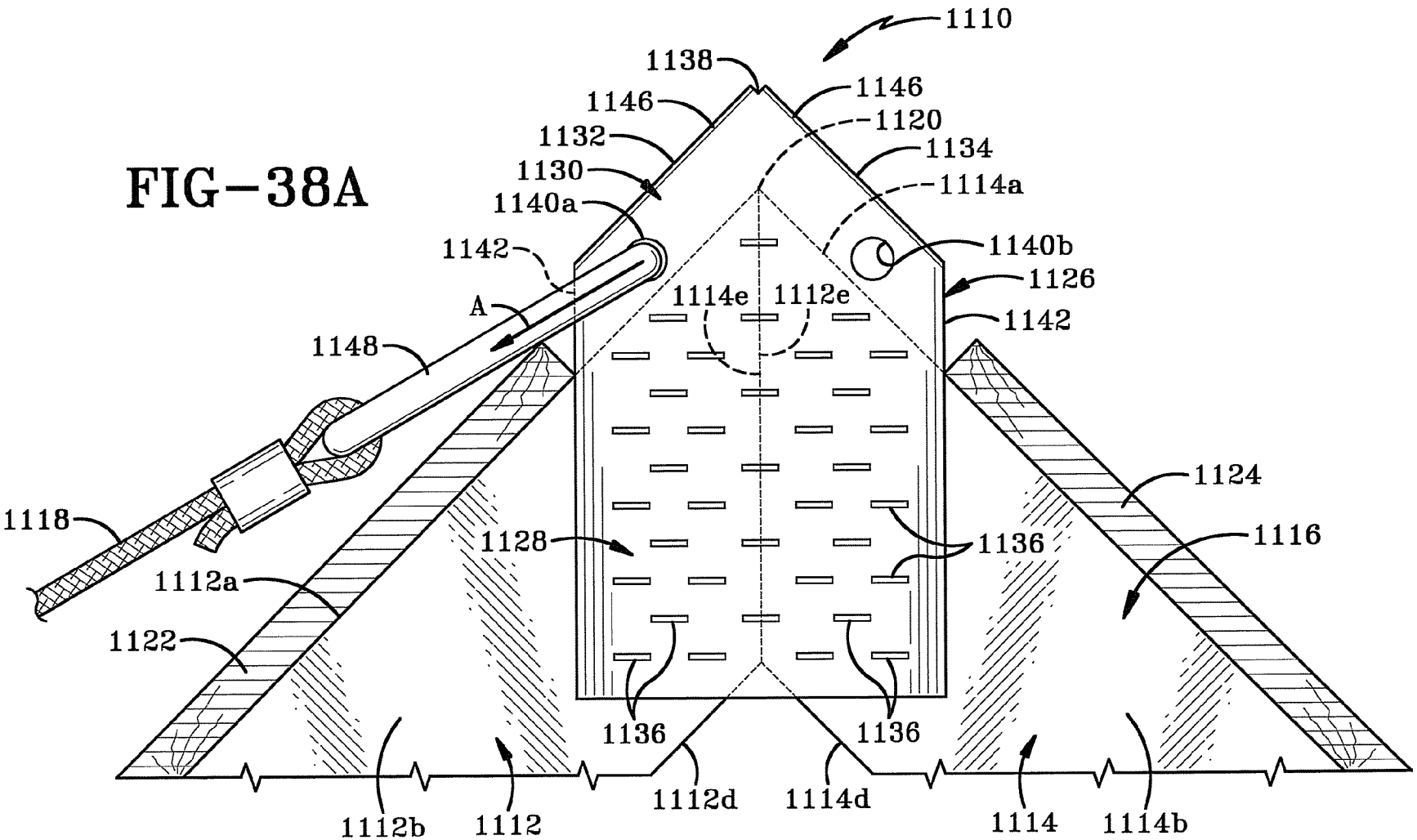
FIG. 38*a* is a front view of the peak gusset of FIG. 37 with a carabiner and rope secured through a first one of the holes in the gusset.
Figure 38B:
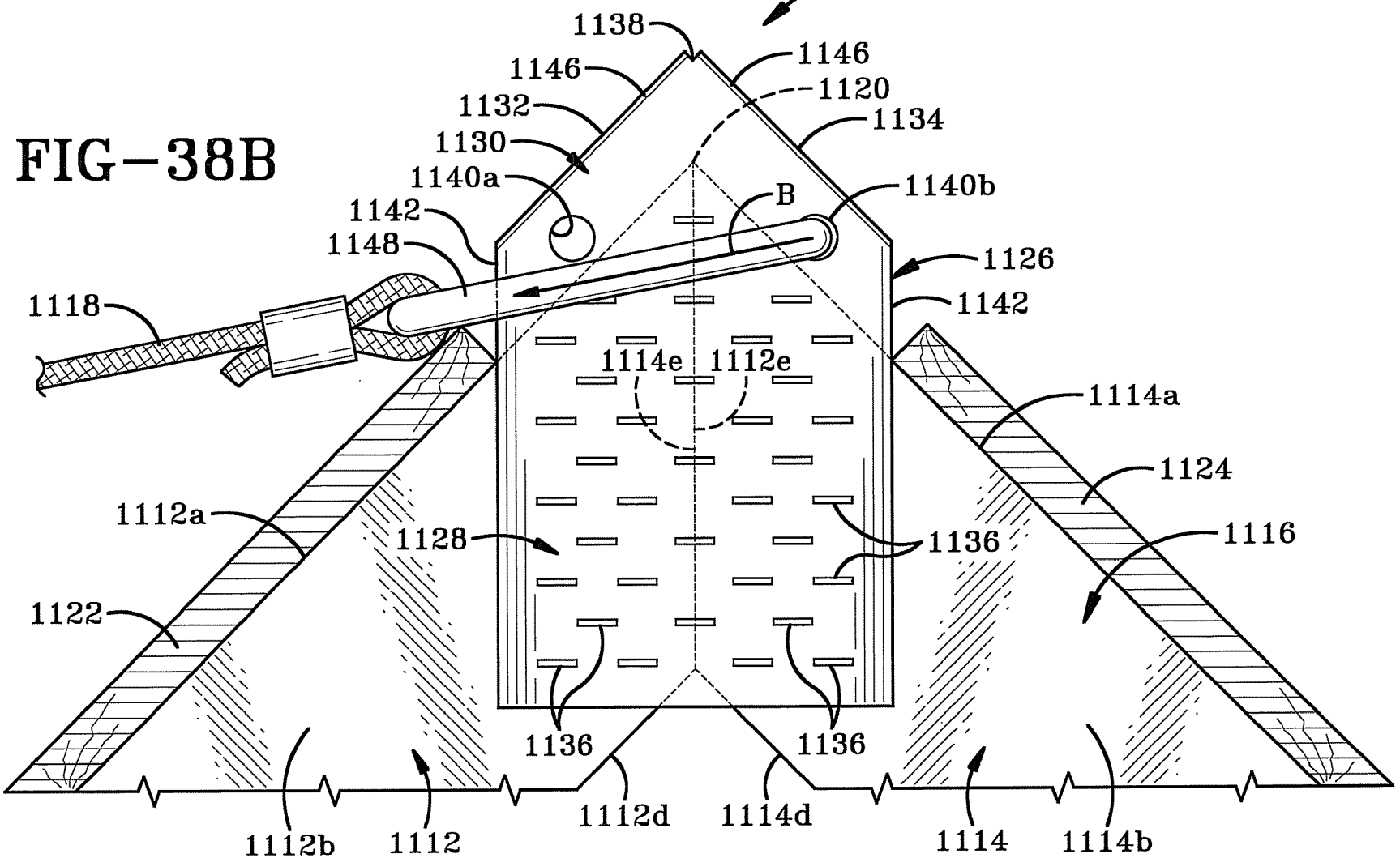
FIG. 38*b* is a front view of the peak gusset of FIG. 37 with the carabiner and rope secured through the second one of the holes in the gusset.
Figure 39:
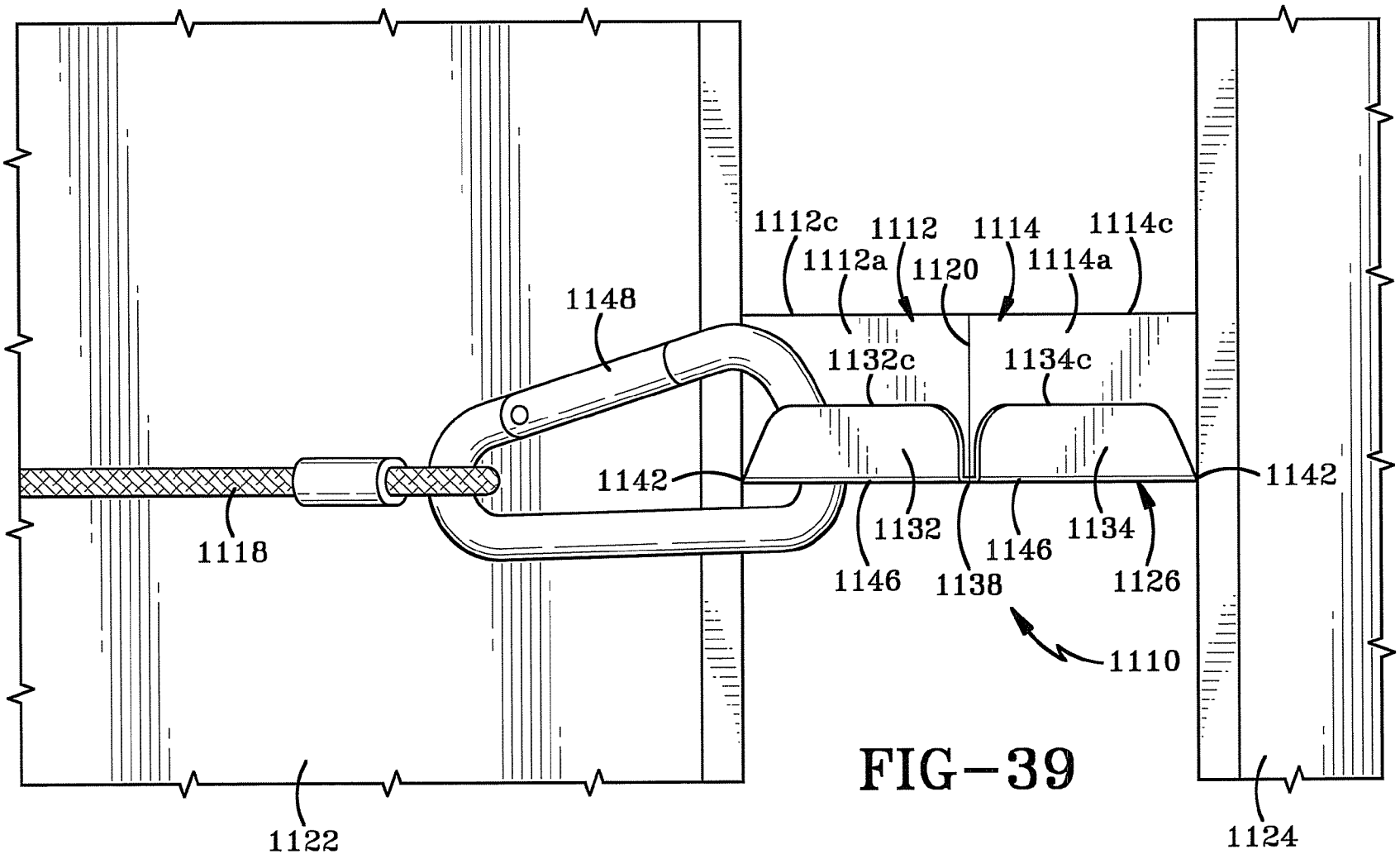
FIG. 39 is a top view of the peak gusset of FIG. 38 with the carabiner resting on the uppermost edge of the sheet material.
Figure 43:
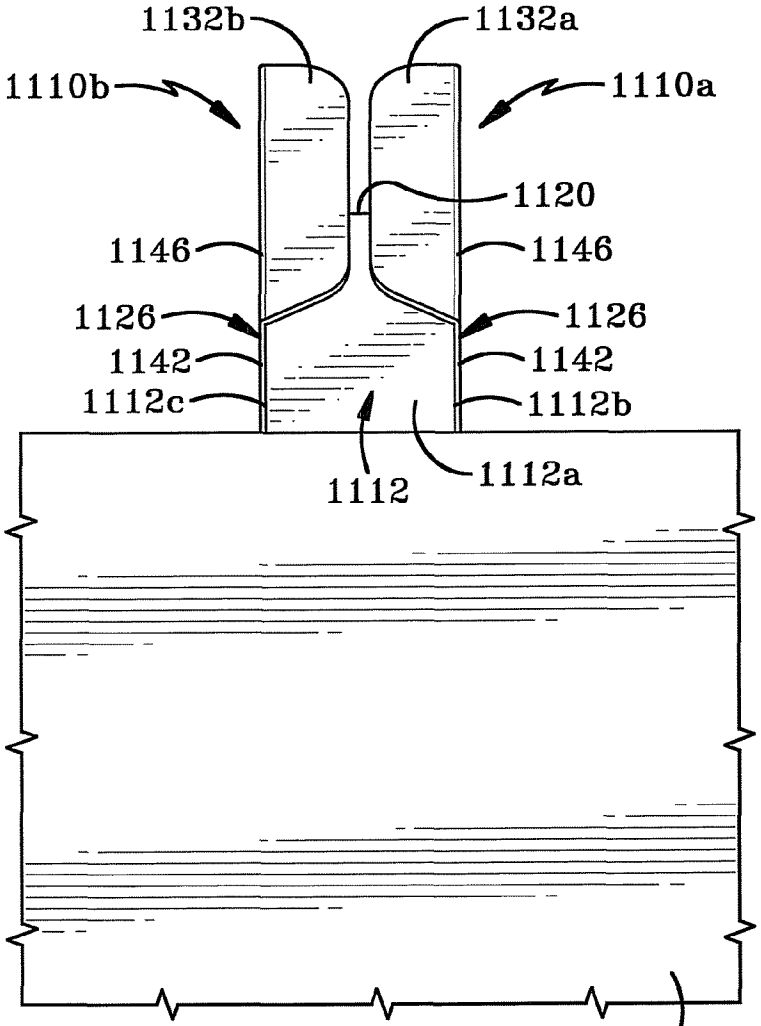
FIG. 43 is a side view of the pair of peak gussets of FIG. 42.
Figure 40:
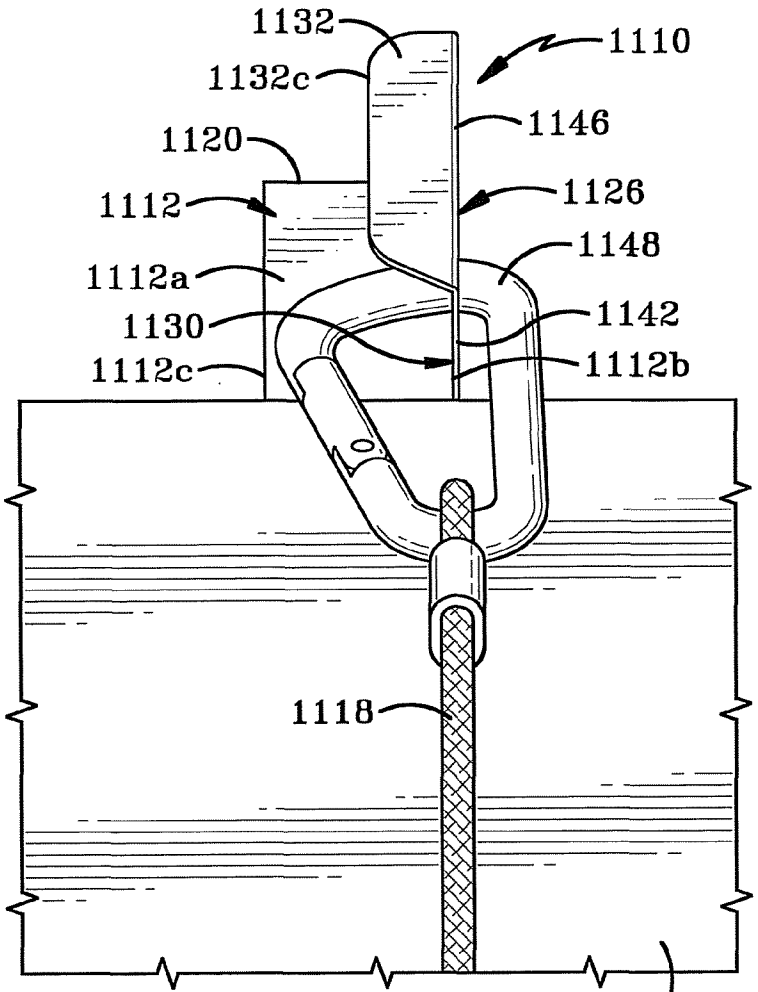
FIG. 40 is a side view of the peak gusset of FIG. 38 showing the top flap folded over.

Flaps 1132, 1134 are integral with anchor portion 1130 and extend outwardly away therefrom. These flaps add metal strength and resistance to peak gusset 1110. Flaps 1132, 1134 may be left coplanar with and extended outwardly away from anchor portion 1130 as shown in FIG. 37. Each flap 1132, 1134 is provided with an arcuate or rounded outermost edge 1132*c*, 1134*c* so as not to present any sharp edges or corners on which a workman may injure himself when the flaps are in this coplanar position. Flaps 1132, 1134 may be separated from each other by a small space 1144 proximate apex 1138 of anchor portion 1130. Space 1144 permits each flap 1132, 1134 to be individually bent about a fold line 1146 and out of alignment with anchor portion 1130. Alternatively, instead of providing a space 1144 between flaps 1132, 1134, they may be overlapped (not shown) to offer more metal strength to peak gusset 1110. Flaps 1132, 1134 may be bent through ninety degrees and into a first position where they extend outwardly at right angles to anchor portion 1130. It will be understood that flaps may be bent through ninety degrees and in a direction where they extend over the wood truss members 1112, 1114 as shown in FIGS. 38 and 39, or they may be bent through ninety degrees in the opposite direction and therefore away from truss members 1112, 1114 (not shown). When flaps 1132, 1134 are bent into the first position, the rounded upper edge formed along the fold line 1146 presents a smooth surface that ensures a workman is less likely to injure himself on peak gusset 1110. The steel selected for peak gusset 1110 is, of course, of a sufficient strength to enable just a single peak gusset to be utilized as a securing anchor. The steel might therefore require tempering or might need to be of increased thickness, at least in the region of anchor portion 1130. Although not illustrated in the attached drawings, one method of achieving an increase in the steel thickness in the anchor portion region would be to bend flaps 1132, 1134 through 180 degrees so that they are in a second position. It will be understood that this bending can be accomplished in a first direction where flaps 1132, 1134 are bent so that they abut the rear surface of peak gusset 1110 or in a second direction where they abut the front surface of peak gusset. Apertures will then have to be punched through both flaps 1132, 1134 so as to align with holes 1140 in anchor portion 1130. This will double the strength of the material around holes 1140 and reduce the possibility of failure of peak gusset 1110. In this second position, fold line 1146 in gusset 1110 would again be smooth and rounded to aid in preventing possible accidents. It will be understood that flaps 1132, 1134 may be put into either of the first and second positions at the manufacturing facility or at the building site.

The peak gusset 1110 of the present invention is used as part of an anchoring system that includes gusset 1110, and a security line 1118. The roof being constructed requires the use of a plurality of roof trusses that are substantially identical to first roof truss 1116, each truss having a peak gusset 1110 secured thereto. The plurality of roof trusses can be considered to have a longitudinal axis that extends horizontally through the aligned peaks of the trusses. Each peak gusset 1110 is secured to one of the plurality of roof trusses substantially at right angles to this longitudinal axis. Once all of the roof trusses 1116 are mounted to the wall framing, planar sheets of material, such as plywood sheets, are secured thereto and shingles are applied thereon. FIG. 37 shows a first sheet member 1122 secured to upper surface 1112*a* of first truss member 1112 and a second sheet member 1124 secured to upper surface 1114*a* of second truss member 1114. Sheet members 1122, 1124 do not extend all of the way to peak 1120 but, instead, have an edge that terminates a short distance away therefrom. Consequently, a gap is formed between the edges of sheet members 1122, 1124 and this gap is of a width "X". The gap allows hot air trapped in the roof to escape from beneath sheet members 1122, 1124. The gap, which runs substantially the entire length of the roof, is ultimately covered by a ventilation cap 1150 (FIG. 41) as will be hereinafter described. Peak gusset 1110 is of a width suitable to be received in the gap between the ends of sheet members 1122, 1124. Peak gusset 1110 may be sized to be complementary to the gap and therefore have a width substantially equal to "X". Alternatively, gusset 1110 may be of a slightly smaller width than "X". It will be understood the sheet members 1122, 1124 are secured to truss 1116 and to a second truss (not shown) that is spaced a distance horizontally apart from truss 1116. First sheet member 1122 extends between coplanar first upper walls of the first and second trusses; and second sheet member 1124 extends between coplanar second upper walls of the first and second trusses. The gap runs between the edges of these first and second sheets from the first truss to the second truss. A second, substantially identical gusset plate may be installed in a substantially identical manner to the manner described with reference to gusset plate 1110.

When a workman is ready to roof the building, he attaches a first connector (not shown) at a first end of security line 1118 to a harness that he is wearing. He also attaches a carabiner 1148 that is at a second end of security line 1118 to one of the holes 1140 of peak gusset 1110. As shown in FIG. 38*a*, carabiner 1148, with security line 1118 attached thereto, may be secured through hole 1140*a* in peak gusset 1110. In this instance, hole 1140*a* is on the same side of the roof as the workman and the line of force on peak gusset 1110 is indicated by arrow "A". Alternatively, as shown in FIG. 38*b*, carabiner 1148 may be secured through hole 1140*b* on peak gusset 1110. Hole 140*b* is on the opposite side of peak gusset 1110 from the position of the workman on the roof. Consequently, the line of force "B" will be directed through the wood of the peak 1120 of the truss 1116. Thus, truss 1116 itself aids in acting as a support for the workman. The workman can install sheet members 1122, 1124 and shingles (not shown) in relative safety while attached via security line 1118 to peak gusset 1110. As he moves to the next section of the roof, he can detach carabiner 1148 from peak gusset 1110 on roof truss 1116 and attach the same to a peak gusset installed on another roof truss. Although not illustrated in FIGS. 37-41, an anchoring device may be applied to security line 1118 in place of carabiner 1148 and which is receivable through both holes 1140*a*, 1140*b* on peak gusset 1110.

Figure 41:
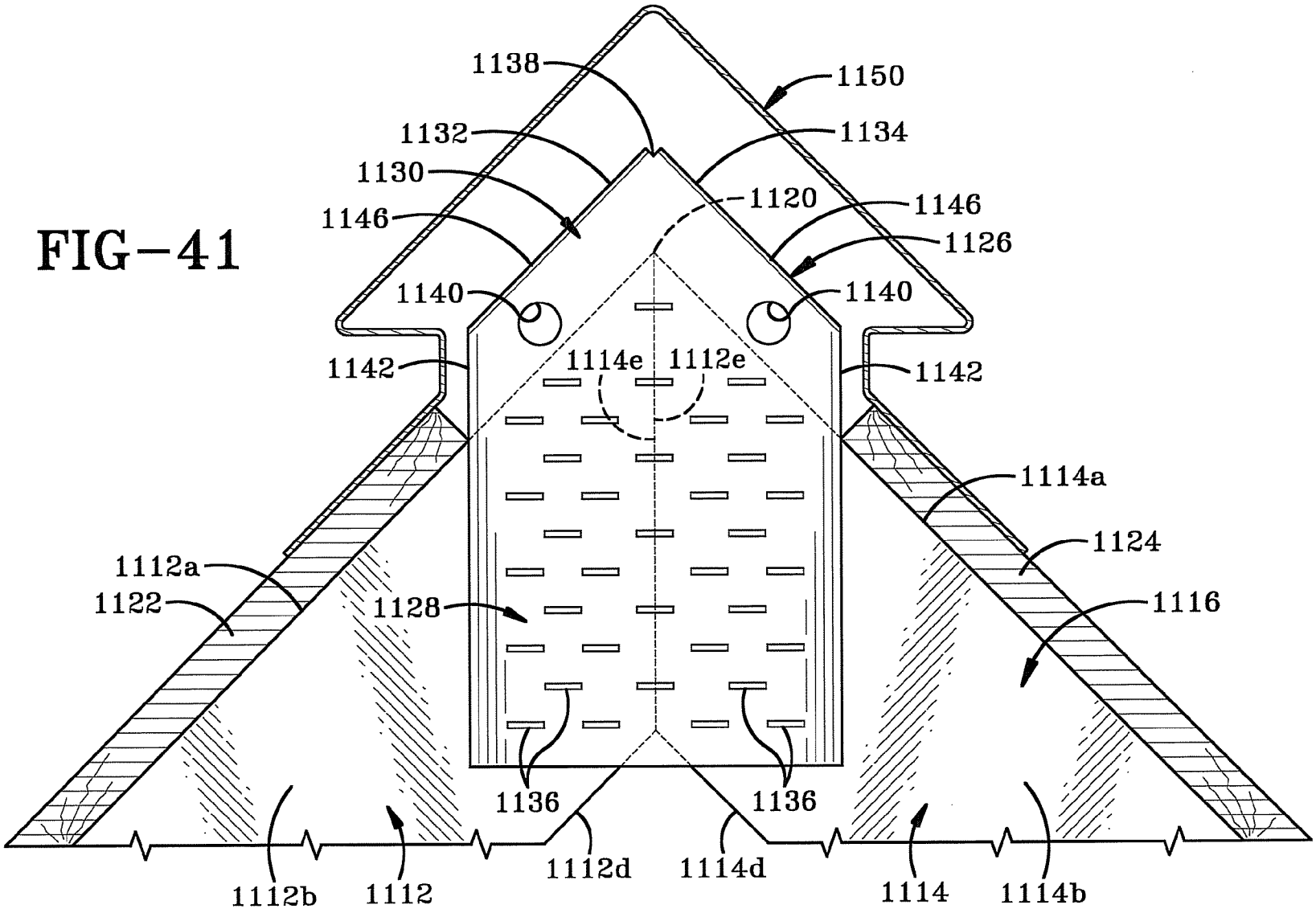
FIG. 41 is a front view of the peak gusset in accordance with the present invention secured to a truss and covered by a ventilation cap.
Figure 42:
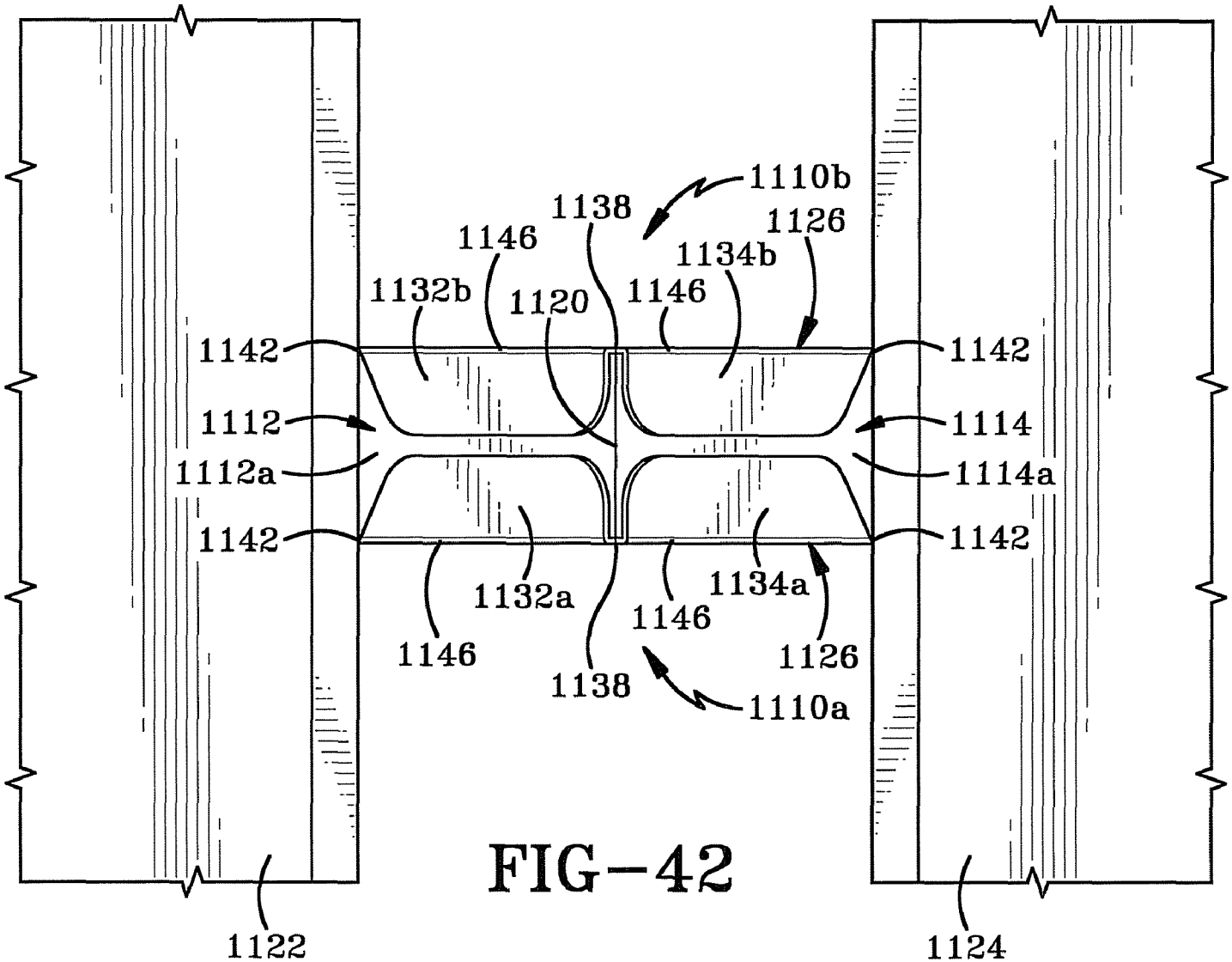
FIG. 42 is a top view of a pair of peak gussets secured on either side of a truss with sheet members extending outwardly away therefrom.

It should be noted that peak gusset 1110 is not removed once the roof is completed. Because holes 1140 are beneath peak 1120 of truss 1116, they are always available for attachment of a carabiner 1148 thereto. Anchor portion 1130 does not need to be cut down in order to install ventilation cap 1150 thereover as shown in FIG. 41. It will be understood that if flaps 1132, 1134 have not been previously bent out of alignment with anchor portion 1130, they may be bent through 900 in order to reduce the height of peak gusset 1110 before ventilation cap 1150 is secured to sheet members 1122, 1124. Ventilation gap 1150 will therefore span the gap between first and second sheet members 1122, 1124 and between a first and a second truss member.

FIGS. 42-46 show that a pair of peak gussets 1110*a*, 1110*b* may be used to secure truss members 1112, 1114 together and to provide an anchoring point for an anchoring system 1152. Peak gussets 1110*a*, 1110*b* are substantially identical to each other. Peak gusset 1110*a* is applied to a first side surface 1112*b*, 1114*b* of truss members 1112, 1114 and peak gusset 1110*b* is applied to the opposing second side surface 1112*c*, 1114*c* thereof. Flaps 1132*a*, 1134*a* on peak gusset 1110*a* may be folded inwardly over truss members 1112, 1114 and flaps 1132*b*, 1134*b* are folded inwardly in the opposite direction. Consequently, first flap 1132*a* on first peak gusset 1110*a* extends toward first flap 1132*b* of second peak gusset 1110*b*, and second flap 1134*a* on first peak gusset 1110*a* extends toward second flap 1134*b* of second peak gusset 1110*b*. Furthermore, the holes 1140 on first peak gusset 1110*a* align with holes in the second peak gusset 1110*b*.

Figure 44:
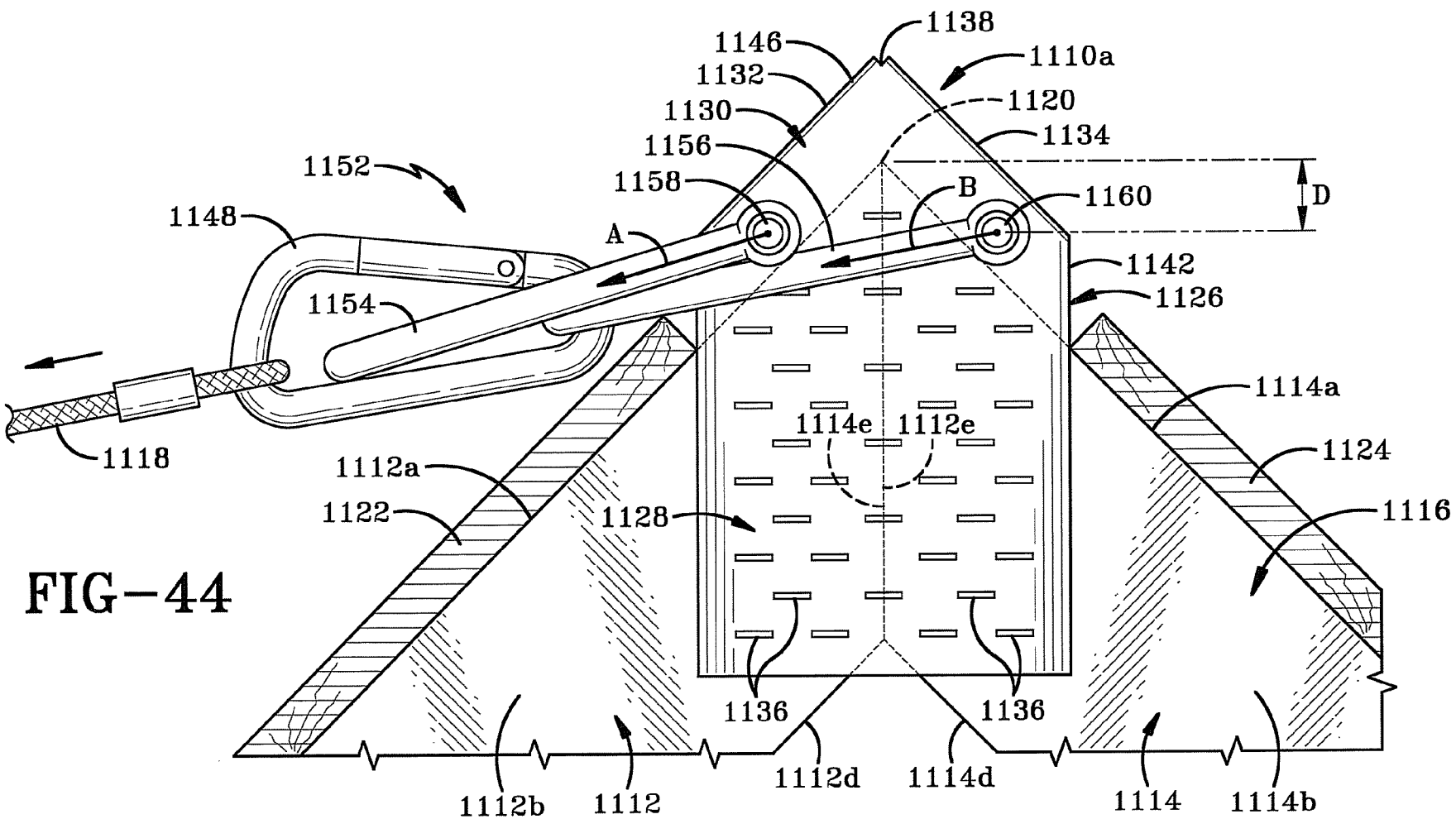
FIG. 44 is front view of the pair of peak gussets of FIG. 42 and showing an anchor system connected thereto.
Figure 45:
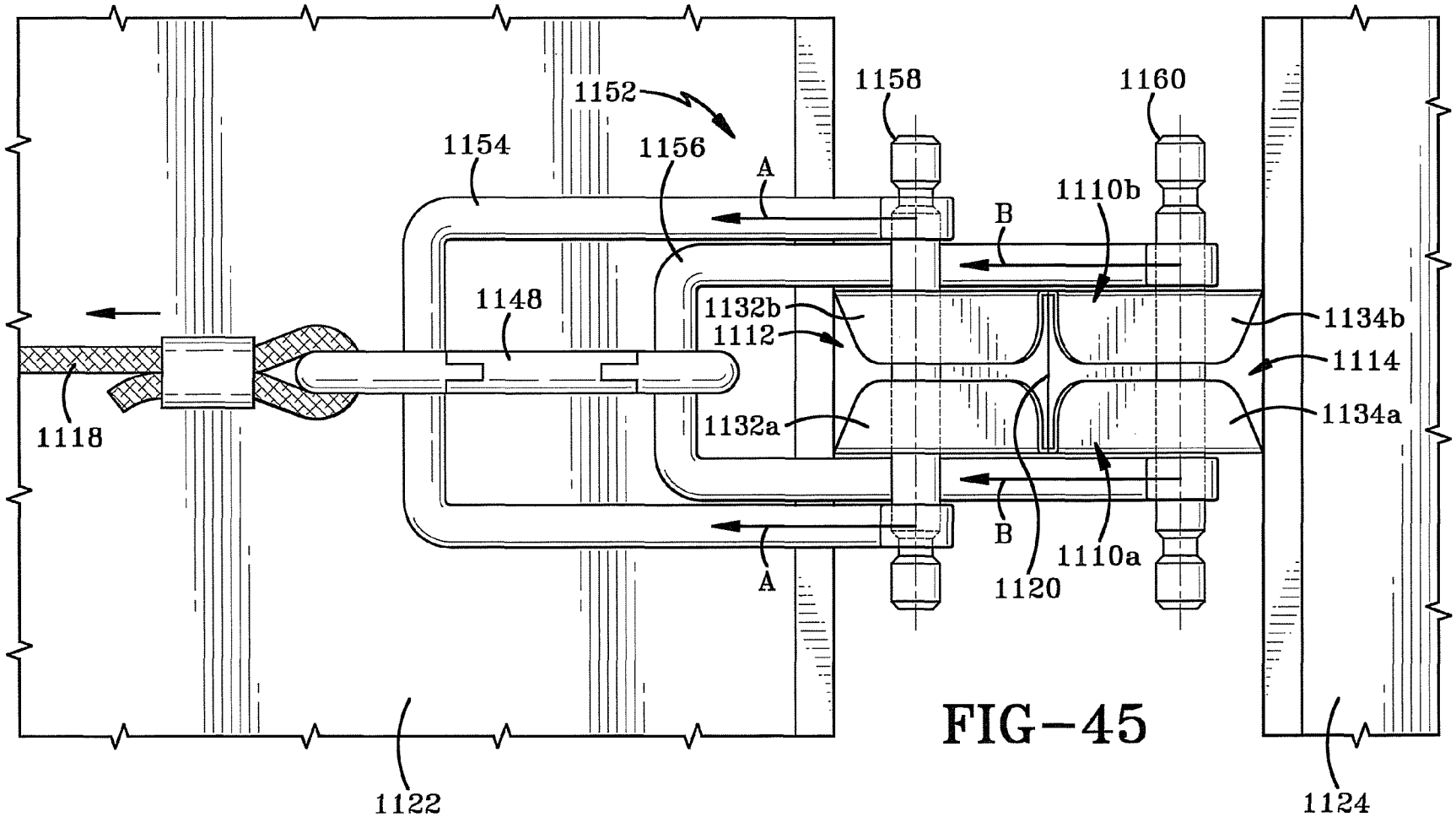
FIG. 45 is a top view of the pair of peak gussets of FIG. 44 showing the anchor system secured thereto.
Figure 46:
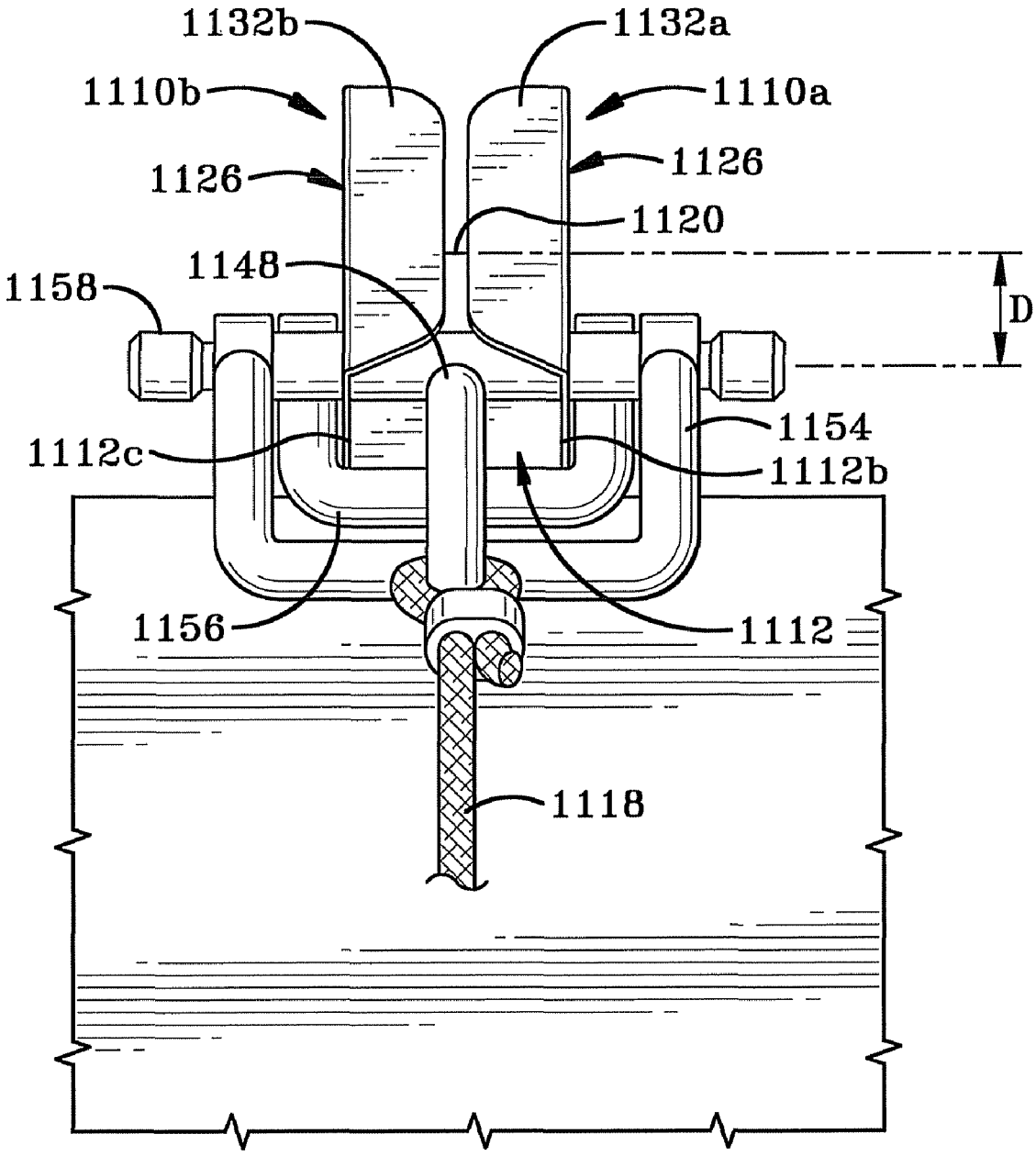
FIG. 46 is a side view of the pair of peak gussets and the anchor system of FIG. 45.

Anchoring system 1152 includes a first connector 1156 and a second connector 1154. A bolt 1160 of first connector 1156 is inserted through a first pair of aligned holes (not numbered) in the first and second peak gussets 1110*a*, 1110*b*. A bolt 1158 of second connector 1154 is inserted through a second pair of aligned holes (not numbered) in the first and second peak gussets 1110*a*, 1110*b*. As shown in FIG. 44, both bolts 1158, 1160 are spaced a distance "D" vertically beneath peak 1120 of truss 1116. A carabiner 1148 engages both of the first and second connectors 1156, 1154 and a security line or cable 1118 is connected to carabiner 1148. As illustrated in FIG. 44, the line of force "B" for the first connector 1156 passes substantially through a portion of the wood of truss 1116 beneath peak 1120, thus strengthening the anchoring system. First connector 1156 may also rest on sheet member 1122 which is secured to the truss member 1112. The support which the peak gussets 1110*a*, 1110*b* can therefore provide is enhanced by the contact with these pieces of sheet material. The presence of two peak gussets 1110*a*, 1110*b* causes the forces from anchoring system 1152 to be more evenly distributed across truss peak 1120.

Figure 47:
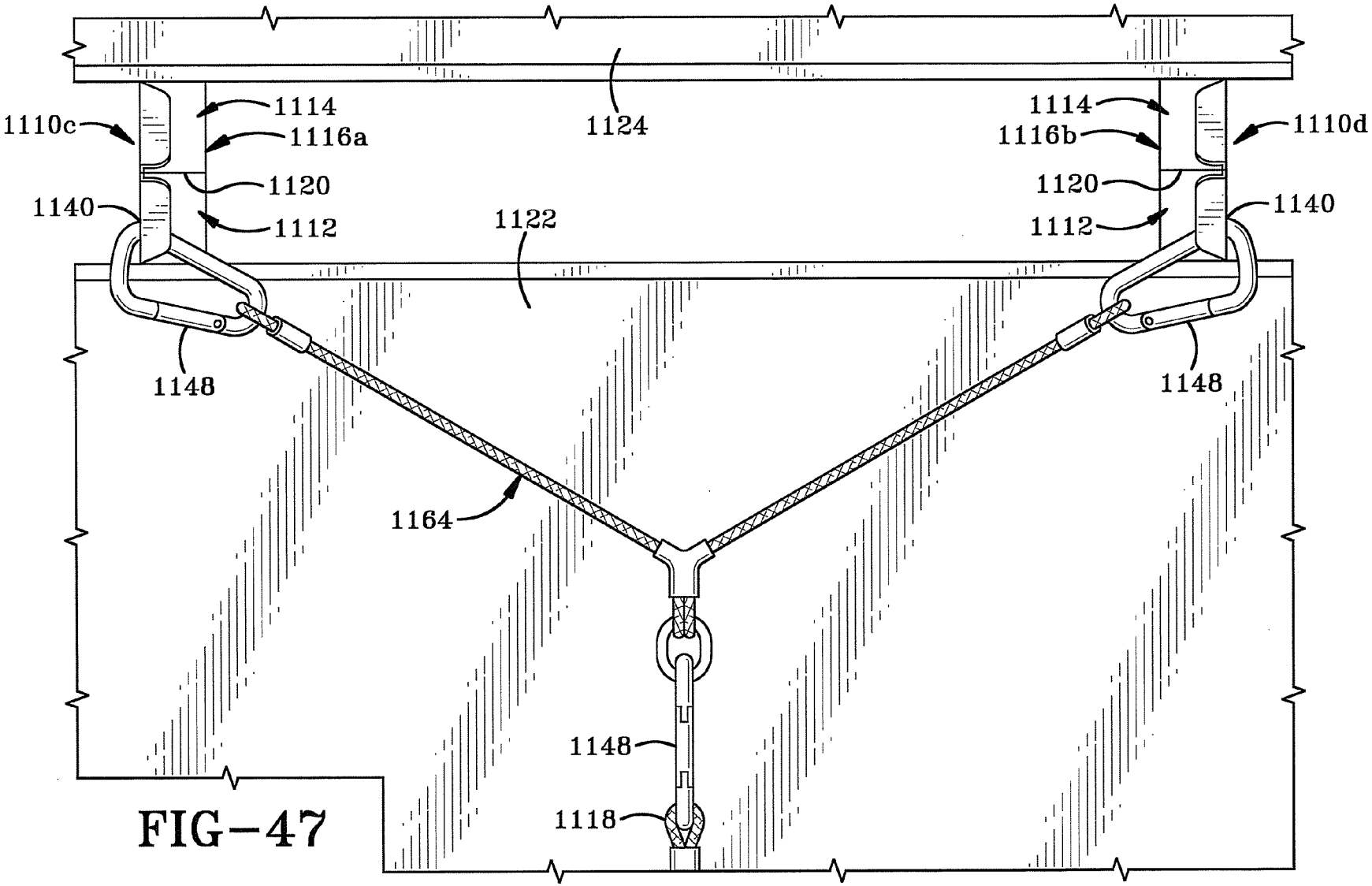
FIG. 47 is a top view of a pair of spaced apart trusses to which peak gussets in accordance with the present invention are secured and showing a cable type of connector member connecting the spaced apart peak gussets and an anchoring system secured thereto.
Figure 48:
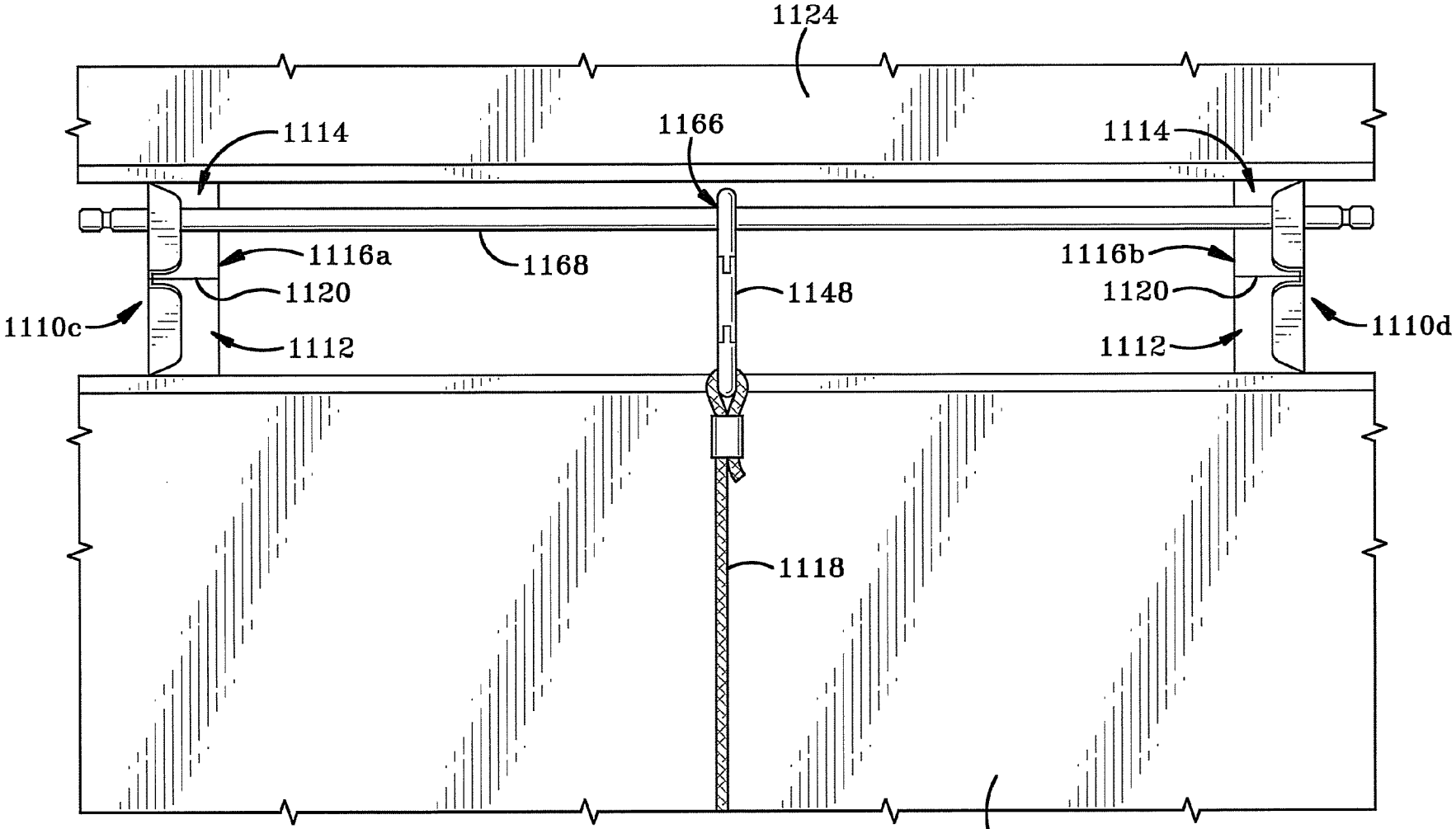
FIG. 48 is a top view of a pair of spaced apart trusses to which peak gussets in accordance with the present invention are secured and showing a rod type of connector member connecting the spaced apart peak gussets and an anchoring system secured thereto.

FIGS. 47 & 48 show a roof anchor system which extends between a first truss 1116*a* and a second truss 1116*b*. Each of the first and second trusses 1116*a*, 1116*b* has a single or double set of peak gussets 1110 secured thereto. In these figures, a single peak gusset 1110*c* is secured to first truss 1116*a* and another single peak gusset 1110*d* is secured to second truss 1116*b*. Preferably the first hole in the first peak gusset 1110*c* aligns with the first hole in the second peak gusset 1110*d*, and the second hole in the first peak gusset 1110*c* aligns with the second hole in the second peak gusset 1110*d*. A connector member extends between the hole in the peak gusset 1110*c* on the first truss 1116*a* and the hole aligned therewith in the peak gusset 1110*d* on the second truss 1116*b*. The connector member may take the form of a Y-cable 1164, such as is shown in FIG. 47 or a rod 1168 shown in FIG. 48. A primary hitch point 1166 is provided along rod 1168 and a carabiner 1148 is secured to hitch point 1166 opposite the side of the roofline on which the workman is working. Because the holes in peak gussets 1110*c*, 1110*d* are beneath peaks 1120 of first and second trusses 1116*a*, 1116*b*, the connector member, i.e., the cable 1164 or rod 1168, is also positioned beneath peaks 1120. The line of force exerted on the security line 1118 therefore passes through at least a portion of the wood of truss members 1112, 1114.

Although the present invention has been described above in detail, the same is by way of illustration and example only and is not to be taken as a limitation on the present invention. It is understood that many variations of the illustrated invention are possible without departing from the scope of the present invention. Accordingly, the scope and content of the present invention are to be defined only by the terms of the appended claims.

The invention claimed is:

1. A roof ridge gusset plate for securement to a roof truss adjacent a truss peak thereof; said gusset plate comprising:

a planar member comprising:

a planar attachment region;

a planar anchor portion integral with and extending outwardly away from said attachment region, wherein said attachment region and anchor portion are coplanar; and wherein said anchor portion has an upper section;

an attachment mechanism adapted to secure the attachment region to the roof truss adjacent the truss peak;

a first hole defined in the anchor portion; wherein-said first hole is adapted to be positioned vertically above an upper wall of the roof truss and below the truss peak when said attachment mechanism is engaged; and a second hole defined in the anchor portion, said second hole being horizontally spaced from said first hole, and when said gusset plate is secured to the roof truss said second hole is adapted to be disposed vertically above a second upper wall of the roof truss and below the truss peak; and said first and second holes are on opposite sides of the truss peak and the gusset plate is adapted to selectively receive a safety line through the first hole or the second hole.

2. The roof ridge gusset plate as defined in claim 1, wherein the planar member has a bottom edge, a first side edge extending upwardly from a first end of the bottom edge, a second side edge extending upwardly from a second end of the bottom edge, and a V-shaped top; and wherein the V-shaped top includes an apex, a first top edge and a second top edge; and wherein the first top edge extends between the apex and a free end of the first side edge, and the second top edge extends between the apex and a free end of the second side edge; and wherein the planar member has a midline that is generally perpendicular to the bottom edge and extends through the apex; and wherein a first portion of the planar member is disposed on one side of the midline and a second portion of the planar member is disposed on an opposite side of the midline; and wherein the anchor portion is located in the V-shaped top of said planar member and the rest of the planar member absent the V-shaped top comprises the attachment region; and wherein the first hole is disposed in the first portion of the planar member a spaced distance from the first top edge and a distance inwardly from the first side edge.

3. The gusset plate as defined in claim 2, further comprising a first flap extending outwardly away from the first top edge of the planar member and at a first angle relative to the longitudinal axis thereof; and a second flap extends outwardly from the second top edge of the planar member and at a second angle relative to the longitudinal axis, wherein the second flap is free of connections to the first flap, and wherein the first and second flaps are independently bendable out of alignment with the planar member.

4. A roof ridge gusset plate for securing a safety line for a workman; said gusset plate comprising:

an attachment region;

an anchor portion integral with and extending outwardly away from said attachment region, said anchor portion having an upper section, an attachment mechanism adapted to secure said attachment region to a roof truss adjacent a truss peak;

a first flap that is integral with and extends outwardly away from said upper section of said anchor portion, said first flap being aligned and coplanar with said anchor portion; and wherein the first flap is bendable out of alignment with the anchor portion to a first position where the first flap is disposed substantially a right angles to the anchor portion; and a first hole defined in the upper section of said anchor portion, wherein said first hole is adapted to be positioned vertically above an upper wall of the roof truss and below the truss peak when said attachment mechanism is engaged; and wherein said first hole is adapted to receive the safety line therethrough.

5. The gusset plate as defined in claim 4, wherein the attachment region is planar and the anchor portion is planar, and wherein the attachment region is substantially coplanar with the anchor region.

6. The gusset plate as defined in claim 4, wherein said attachment mechanism comprises a plurality of teeth that extend outwardly away from said attachment region, and wherein said anchor portion is substantially free of teeth.

7. The gusset plate as defined in claim 4, wherein the first flap is movable bendable out of alignment with the anchor portion to a second position where the first flap is disposed at substantially 180° relative to the anchor portion and the first flap abuts a rear surface of the anchor portion.

8. The gusset plate as defined in claim 7, further comprising an aperture defined in the first flap, said aperture being complementary to the first hole in the anchor portion and alignable therewith when the first flap is bent through 180 degrees, and wherein the aligned aperture and first hole are adapted to receive the security line therethrough.

9. A roof system comprising:

a first truss having a first upper wall and a second upper wall that meet at a first apex;

a first gusset plate non-removably connected to the first truss adjacent the first apex, said first gusset plate comprising:

an attachment region;

an attachment mechanism for retaining the attachment region adjacent the first apex;

an anchor portion integral with and extending outwardly away from said attachment region, said anchor portion extending laterally beyond the first apex when the gusset plate is secured adjacent the same;

a first hole defined in a first region of the anchor portion which extends laterally beyond the first apex in a first direction, said first hole being positioned simultaneously vertically above the first upper wall of the first truss and vertically below said first apex, and wherein said first hole is adapted to receive a first connector of a security line therethrough where the security line is secured to a workman when on a first side of a roof; and a second hole defined in the anchor portion spaced a distance horizontally from the first hole therein; where the second hole is defined in a second region of the anchor portion that extends laterally beyond the first apex in a second direction; and wherein the second hole is simultaneously positioned vertically above the second upper wall of the first truss and below said first apex, and the first and second holes are on opposite sides of the first apex; and wherein the second hole is adapted to selectively receive the first connector of the security line therethrough to support the workman when on a second side of the roof.

10. The roof system as defined in claim 9, wherein the anchor portion is planar and the attachment region is planar, and the anchor portion and attachment region are coplanar.

11. The roof system as defined in claim 9, wherein the uppermost end of the anchor portion of the first gusset plate is V-shaped and includes a plate apex, a first top edge and a second top edge, wherein the first top edge extends between the plate apex and a first side edge of the plate, and the second top edge extends between the plate apex and a second side edge of the plate; and wherein plate has a longitudinal axis that is disposed at right angles to a bottom edge of the plate and extends through the plate apex, and wherein the roof system further includes a flap that extends outwardly away from the first top edge of the plate and at an angle relative to the longitudinal axis of the plate and, when the flap is in a first position, the flap is substantially coplanar with the anchor portion; and wherein the flap is bendable from a first position where it is coplanar with the anchor portion to a second position where it is substantially at right angles or at 180 degrees relative to the anchor portion.

12. A roof system comprising:

a first truss having a first and a second upper wall that meet at a first apex;

a first gusset plate non-removably connected to the first truss adjacent the first apex, said first gusset plate comprising:

an attachment region;

an attachment mechanism for retaining the attachment region adjacent the first apex;

an anchor portion integral with and extending outwardly away from said attachment region, said anchor portion extending laterally beyond the first apex;

a first hole defined in the anchor portion, said first hole being positioned vertically above a first upper wall of the first truss and vertically below said first apex, and wherein said first hole is adapted to receive a first connector of a security line therethrough where the security line is secured to a workman;

a first sheet member secured to the first upper wall, said first sheet member having a first edge that terminates a distance away from the first apex; and a second sheet member secured to the second upper wall; said second sheet member having a second edge that terminates a distance away from the first apex; whereby a gap is formed between the first and second edges; and wherein the first gusset plate is connected to the first truss in the gap.

13. The roof system as defined in claim 12, wherein the first hole in the anchor portion of the first gusset plate is disposed between the first edge of the first sheet member and the first apex.

14. The roof system as defined in claim 13, further comprising:

a vent cap, wherein said vent cap is secured on a first side to the first sheet member and on a second side to the second sheet member; and the vent cap extends across the gap, and wherein the vent cap is disposed above an uppermost end of the anchor portion of the first gusset plate.

15. The roof system as defined in claim 12, further comprising:

a second truss having a first and a second upper wall meeting at second apex; said second truss being spaced a distance horizontally from the first truss, and wherein said first and second apices are aligned; and wherein said first sheet member is secured to both of the first upper walls of the first and second trusses, and the first edge of the first sheet member terminates a distance away from each of the first and second apices;

and wherein said second sheet member is secured to both the second upper walls of the first and second trusses; and the second edge of the second sheet member terminates a distance away from each of the first and second apices; whereby the gap is formed between the first and second edges of the first and second sheet members and the gap extends horizontally between the first and second trusses; and a vent cap, wherein said vent cap is secured on a first side to the first sheet member and on a second side to the second sheet member; and the vent cap extends across the gap, and wherein the vent cap is disposed above an uppermost end of the anchor portion of the first gusset plate.

16. The roof system as defined in claim 15, further comprising:

a second gusset plate non-removably connected to the second truss adjacent the second apex, said second gusset plate comprising:

an attachment region;

an attachment mechanism for retaining the attachment region adjacent the second apex;

an anchor portion integral with and extending outwardly away from said attachment region, said anchor portion extending beyond the second apex;

a first hole defined in the anchor portion of the second gusset plate, said first hole being positioned vertically above the first upper wall of the second truss and vertically below said second apex, and wherein said first hole in the second gusset plate is adapted to receive a second connector of a security anchor therethrough, whereby the security anchor is secured to both of the first and second gusset plates.

17. The roof system as defined in claim 16, wherein the anchor portion of the second gusset plate further defines a second hole spaced a distance from the first hole therein; and the second hole is positioned vertically above the second upper wall of the second truss and below said second apex, whereby the first and second holes in the second gusset plate are on opposite sides of the second apex.

18. The roof system as defined in claim 17, wherein the first hole in the first gusset plate is aligned with the first hole in the second gusset plate; and the second hole in the first gusset plate is aligned with the second hole in the second gusset plate.

19. The roof system as defined in claim 12, wherein the uppermost end of the anchor portion of the first gusset plate is V-shaped and includes a plate apex, a first top edge and a second top edge, wherein the first top edge extends between the plate apex and a first side edge of the plate, and the second top edge extends between the plate apex and a second side edge of the plate; and wherein plate has a longitudinal axis that is disposed at right angles to a bottom edge of the plate and extends through the plate apex, and wherein the roof system further includes a flap that extends outwardly away from the first top edge of the plate and at an angle relative to the longitudinal axis of the plate and, when the flap is in a first position, the flap is substantially coplanar with the anchor portion.

20. The roof system as defined in claim 19, wherein the flap is bendable from the first position where it is coplanar with the anchor portion to a second position where it is substantially at right angles to the anchor portion; and wherein the vent cap is securable to the first and second sheet members when the flap is in one or both of the first and second positions.

21. The roof system as defined in claim 19, further comprising a second flap, wherein said second flap extends outwardly from the second top edge of the plate and at a second angle relative to the longitudinal axis of the plate and, when the second flap is in a first position, the flap is substantially coplanar with the anchor portion and the first flap, and the second flap is bendable from a first position where it is coplanar with the anchor portion to a second position where it is substantially at right angles to the anchor portion; and wherein the vent cap is securable to the first and second sheet members when the second flap is in one or both of the first and second positions.

22. The roof system as defined in claim 21, wherein the flap is free of connections to the second flap, and wherein the flap and second flap are bendable independently of each other.

23. The roof system as defined in claim 12, wherein the anchor portion is planar and the attachment region is planar, and the anchor portion and attachment region are coplanar.

* * * * *

UNITED STATES PATENT AND TRADEMARK OFFICE

CERTIFICATE OF CORRECTION

PATENT NO. : 8,028,477 B2
APPLICATION NO. : 12/100122
DATED : October 4, 2011
INVENTOR(S) : Crookston It is certified that error appears in the above-identified patent and that said Letters Patent is hereby corrected as shown below:

Column 14, line 11 (Claim 4) "substantially a right angles" should be changed to --substantially at right angles--.

Column 14, line 29 (Claim 7) "flap is movable bendable" should be changed to --flap is bendable--.

Signed and Sealed this
Twenty-ninth Day of November, 2011

David J. Kappos

David J. Kappos
*Director of the United States Patent and Trademark Office*